US010556437B2

(12) United States Patent
Nakajima et al.

(10) Patent No.: US 10,556,437 B2
(45) Date of Patent: Feb. 11, 2020

(54) LIQUID EJECTING APPARATUS AND METHOD OF DRIVING THE SAME

(71) Applicant: SEIKO EPSON CORPORATION, Tokyo (JP)

(72) Inventors: Yoshinori Nakajima, Matsumoto (JP); Takahiro Kanegae, Shiojiri (JP); Hiroshige Owaki, Okaya (JP); Shigeki Suzuki, Shiojiri (JP); Hironori Matsuoka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/116,131

(22) Filed: Aug. 29, 2018

(65) Prior Publication Data

US 2019/0061364 A1 Feb. 28, 2019

(30) Foreign Application Priority Data

Aug. 30, 2017 (JP) ..... 2017-166259

(51) Int. Cl.

| | |
|---|---|
| ***B41J 2/175*** | (2006.01) |
| ***B41J 2/14*** | (2006.01) |
| ***B41J 2/19*** | (2006.01) |
| ***B41J 2/045*** | (2006.01) |

(52) U.S. Cl.

CPC ..... *B41J 2/17563* (2013.01); *B41J 2/04581* (2013.01); *B41J 2/14233* (2013.01); *B41J 2/175* (2013.01); *B41J 2/17596* (2013.01); *B41J 2/19* (2013.01); *B41J 2002/14241* (2013.01); *B41J 2002/14419* (2013.01); *B41J 2202/07* (2013.01); *B41J 2202/11* (2013.01); *B41J 2202/12* (2013.01)

(58) Field of Classification Search

CPC .... B41J 2/17563; B41J 2/14233; B41J 2/175; B41J 2/04581; B41J 2/17596; B41J 2/19; B41J 2202/11; B41J 2002/14419; B41J 2002/14241; B41J 2202/12; B41J 2202/07

See application file for complete search history.

(56) References Cited

U.S. PATENT DOCUMENTS

| | | | | |
|---|---|---|---|---|
| 9,370,935 | B2 * | 6/2016 | Nawano | B41J 2/17563 |
| 10,076,912 | B2 * | 9/2018 | Kanegae | B41J 2/17596 |
| 2015/0352855 | A1 | 12/2015 | Nawano et al. | |
| 2017/0305155 | A1 | 10/2017 | Kanegae | |

FOREIGN PATENT DOCUMENTS

| | | |
|---|---|---|
| JP | 09-109409 | 4/1997 |
| JP | 2007-152755 | 6/2007 |
| JP | 2011-000746 | 1/2011 |
| JP | 2015-231723 | 12/2015 |
| JP | 2017-193132 | 10/2017 |

* cited by examiner

*Primary Examiner* — Huan H Tran

(74) *Attorney, Agent, or Firm* — Workman Nydegger

(57) ABSTRACT

A liquid ejecting apparatus includes a liquid path comprising a filter and a liquid storing chamber for supplying liquid to a liquid ejecting head. The liquid storing chamber has an inlet, a bubble retention space disposed above the inlet, a bottom disposed below the bubble retention space, and a first outlet and a second outlet. (i) The first outlet is located on one side of an imaginary center line passing through the center of a projected area, and the second outlet is located on the other side of the imaginary center line. Alternatively, (ii) the first outlet and the second outlet are located outside a projected area defined by projecting the bubble retention space onto the bottom.

20 Claims, 14 Drawing Sheets

LIQUID EJECTING APPARATUS AND METHOD OF DRIVING THE SAME

CROSS REFERENCES TO RELATED APPLICATIONS

This application claims priority to Japanese Patent Application No. 2017-166259 filed on Aug. 30, 2017. The entire disclosure of Japanese Patent Application No. 2017-166259 is incorporated herein by reference.

BACKGROUND

1. Technical Field

The present invention relates to a technique of ejecting a liquid, such as ink.

2. Related Art

Some liquid ejecting apparatuses, which include a liquid ejecting head for ejecting a liquid (for example, ink) supplied from a liquid container along a liquid path, are equipped with a filter for removing bubbles that have entered the liquid path and a space for temporarily retaining such bubbles in the middle of the liquid path so as to suppress the bubbles from flowing into the liquid ejecting head. For example, JP-A-2015-231723 discloses an apparatus that includes a filter in the middle of a liquid path and a bubble chamber disposed upstream of the filter. The bubble chamber has a bubble retention space for retaining bubbles that have been successfully captured by the filter.

Undesirably, the bubble retention space in the apparatus disclosed in JP-A-2015-231723 is disposed upstream of the filter and therefore cannot retain bubbles that have passed through the filter. Such bubbles may flow into the liquid ejecting head. To solve this problem, another bubble retention space can be provided downstream of the filter. This space can retain the bubbles that have passed through the filter and thus suppress these bubbles from flowing into the liquid ejecting head and its nozzles. Some types of liquid, however, often generate by-products (solid materials) due to evaporation of the solvent of the liquid at the air-liquid interface where the liquid is in contact with the bubbles retained in the bubble retention space. The by-products generated downstream of the filter cannot be removed by the filter and thus may flow into the liquid ejecting head and its nozzles, resulting in irregular ejection.

SUMMARY

An advantage of some aspects of the invention is to suppress the by-products generated downstream of the filter from flowing into the liquid ejecting head and its nozzles.

A liquid ejecting apparatus according to a first aspect of the invention, which has been proposed to realize the above advantage, includes a filter disposed in a liquid path for supplying liquid to nozzles of a liquid ejecting head, and a liquid storing chamber disposed downstream of the filter in the liquid path. The liquid storing chamber has an inlet through which the liquid enters the liquid storing chamber, a bubble retention space disposed above the inlet in the vertical direction, a bottom disposed below the bubble retention space in the vertical direction, and a first outlet and a second outlet through which the liquid exits the liquid storing chamber. The first outlet is located on one side of an imaginary center line passing through the center of a projected area, which is defined by projecting the bubble retention space onto the bottom in the vertical direction, and the second outlet is located on the other side of the imaginary center line, as viewed in the vertical direction. The liquid storing chamber disposed downstream of the filter can cause the bubbles that have passed through the filter and entered the liquid storing chamber through the inlet to be retained in the bubble retention space. If by-products are generated at the air-liquid interface between the bubbles (gas) and the liquid in the bubble retention space and sink, the configuration can cause such by-products to be accumulated in the projected area on the bottom. In addition, the first outlet and the second outlet are located on both sides of the imaginary center line of the projected area, as viewed in the vertical direction. The liquid exits the liquid storing chamber through the first outlet and the second outlet, thereby generating liquid flows having components in the opposite directions from the imaginary center line of the projected area to the first outlet and the second outlet. The liquid flow components in the opposite directions cancel movements of the by-products accumulated in the projected area and thus suppress the by-products from reaching the first outlet or the second outlet. This configuration can suppress the by-products generated in the bubble retention space downstream of the filter from flowing into the liquid ejecting head and its nozzles through the first outlet or the second outlet.

A liquid ejecting apparatus according to a second aspect of the invention, which has been proposed to realize the above advantage, includes a filter disposed in a liquid path for supplying liquid to nozzles of a liquid ejecting head, and a liquid storing chamber disposed downstream of the filter in the liquid path. The liquid storing chamber has an inlet through which the liquid enters the liquid storing chamber, a bubble retention space disposed above the inlet in the vertical direction, a bottom disposed below the bubble retention space in the vertical direction, and a first outlet and a second outlet through which the liquid exits the liquid storing chamber. The first outlet and the second outlet are located outside a projected area defined by projecting the bubble retention space onto the bottom in the vertical direction, as viewed in the vertical direction. If by-products are generated at the air-liquid interface between the bubbles (gas) and the liquid in the bubble retention space downstream of the filter and sink, the configuration can cause such by-products to be accumulated in the projected area on the bottom. Furthermore, the first outlet and the second outlet are located outside the projected area defined by projecting the bubble retention space onto the bottom in the vertical direction, as viewed in the vertical direction. This configuration can suppress the by-products that have sunk from the bubble retention space from reaching the first outlet or the second outlet. The configuration can thus suppress the by-products generated in the bubble retention space downstream of the filter from flowing into the liquid ejecting head and its nozzles through the first outlet or the second outlet.

It is preferable that the direction from the center of the projected area to the second outlet be opposite to the direction from the center of the projected area to the first outlet, as viewed in the vertical direction. This configuration can facilitate generation of liquid flows in the opposite directions from the center of the projected area to the first outlet and the second outlet, because the direction from the center of the projected area to the second outlet is opposite to the direction from the center of the projected area to the first outlet, as viewed in the vertical direction. The configuration can thus effectively suppress the by-products accumulated in the projected area from approaching the first outlet or the second outlet.

It is preferable that the liquid storing chamber have a section that is orthogonal to the vertical direction, is located below the bubble retention space in the vertical direction, and has an area smaller than the area of the bottom. The projected area of the bubble retention space can have a smaller area than the area of the bottom, because the liquid storing chamber has a section that is orthogonal to the vertical direction, is located below the bubble retention space in the vertical direction, and has a smaller area than the area of the bottom. This configuration can cause the by-products sinking from the bubble retention space to be readily accumulated in the vicinity of the center of the projected area. That is, the configuration can keep the by-products accumulated in the projected area away from the first outlet and the second outlet, thereby suppressing the by-products from flowing out.

It is preferable that the liquid storing chamber have a section that is orthogonal to the vertical direction, is located below the bubble retention space in the vertical direction, and has the smallest area. This configuration can provide a larger section to a bubble retention space than the smallest section, because of the smallest section located below the bubble retention space in the vertical direction. In addition, regardless of the larger bubble retention space, the configuration can cause the by-products sinking from the bubble retention space to be accumulated in the area defined by projecting the smallest section onto the bottom, which is smaller than the projected area of the bubble retention space. That is, the configuration can keep the by-products accumulated in the projected area away from the first outlet and the second outlet, thereby suppressing the by-products from flowing out.

It is preferable that the bottom be provided with a restricting portion that is disposed at least between the first outlet and the projected area and between the second outlet and the projected area, as viewed in the vertical direction, and that restricts movement of by-products accumulated on the bottom. This configuration can suppress the by-products from approaching the first outlet and the second outlet across the restricting portion regardless of the occurrence of a liquid flow on the bottom that brings the by-products, because of the restricting portion on the bottom that is disposed at least between the first outlet and the projected area and between the second outlet and the projected area, as viewed in the vertical direction, and that restricts movement of the by-products accumulated on the bottom. The configuration can thus more effectively suppress the by-products from flowing into the liquid ejecting head and its nozzles, compared with the configuration without a restricting portion.

It is preferable that the first outlet and the second outlet be located below the inlet in the vertical direction. This configuration, including the first outlet and the second outlet located below the inlet in the vertical direction, can provide a larger bubble retention space, compared with the configuration including the first outlet and the second outlet located above the inlet.

It is preferable that the first outlet and the second outlet be located below the center of the liquid storing chamber in the vertical direction. This configuration, including the first outlet and the second outlet located below the center of the liquid storing chamber in the vertical direction, can provide a larger bubble retention space and more readily guide bubbles into the bubble retention space using buoyancy, compared with the configuration including the first outlet and the second outlet located above the center of the liquid storing chamber.

It is preferable that the liquid ejecting apparatus further include a degassing chamber that is disposed above the bubble retention space in the vertical direction and that degases the liquid with a gas permeable film. This configuration can cause the bubbles retained in the bubble retention space to be discharged to the degassing chamber, because of the degassing chamber that is disposed above the bubble retention space in the vertical direction and that degases the liquid with the gas permeable film. The configuration can thus reduce the generation of by-products at the air-liquid interface between the bubbles and the liquid in the bubble retention space.

It is preferable that the liquid be caused to exit the liquid storing chamber through one of the first outlet and the second outlet so as to generate a flow of the liquid on the bottom. This configuration can cause the by-products accumulated on the bottom to be discharged through one of the first outlet and the second outlet with the flow of the liquid.

A method of driving a liquid ejecting apparatus according to a third aspect, which has been proposed to realize the above advantage, is directed at a liquid ejecting apparatus including a filter disposed in a liquid path for supplying liquid to nozzles of a liquid ejecting head, and a liquid storing chamber disposed downstream of the filter in the liquid path. The liquid storing chamber has an inlet through which the liquid enters the liquid storing chamber, a bubble retention space disposed above the inlet in the vertical direction, a bottom disposed below the bubble retention space in the vertical direction, and a first outlet and a second outlet through which the liquid exits the liquid storing chamber. The first outlet is located on one side of an imaginary center line passing through the center of a projected area, which is defined by projecting the bubble retention space onto the bottom in the vertical direction, and the second outlet is located on the other side of the imaginary center line, as viewed in the vertical direction. The method involves causing the liquid to exit the liquid storing chamber through the first outlet and the second outlet. The liquid storing chamber disposed downstream of the filter can cause the bubbles that have passed through the filter and entered the liquid storing chamber through the inlet to be retained in the bubble retention space. If by-products are generated at the air-liquid interface between the bubbles and the liquid in the bubble retention space and sink, the configuration can cause such by-products to be accumulated in the projected area on the bottom. In addition, the liquid exits the liquid storing chamber through the first outlet and the second outlet disposed on both sides of the imaginary center line of the projected area, as viewed in the vertical direction, thereby generating liquid flows having components in the opposite directions from the imaginary center line of the projected area to the first outlet and the second outlet. The liquid flow components in the opposite directions cancel movements of the by-products accumulated in the projected area and thus suppress the by-products from reaching the first outlet or the second outlet. This configuration can thus suppress the by-products generated in the bubble retention space downstream of the filter from flowing into the liquid ejecting head and its nozzles through the first outlet or the second outlet.

It is preferable that the liquid ejecting apparatus further include a degassing chamber that is disposed above the bubble retention space in the vertical direction and that degases the liquid with a gas permeable film, and that the method further involve discharging bubbles retained in the bubble retention space to the degassing chamber. This configuration can cause the bubbles retained in the bubble retention space to be discharged to the degassing chamber and can thus reduce the generation of by-products at the air-liquid interface between the bubbles and the liquid in the bubble retention space.

It is preferable that the method further involve causing the liquid to exit the liquid storing chamber through one of the first outlet and the second outlet and generating a flow of the liquid on the bottom. This configuration can cause the by-products accumulated on the bottom to be discharged through one of the first outlet and the second outlet with the flow of the liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
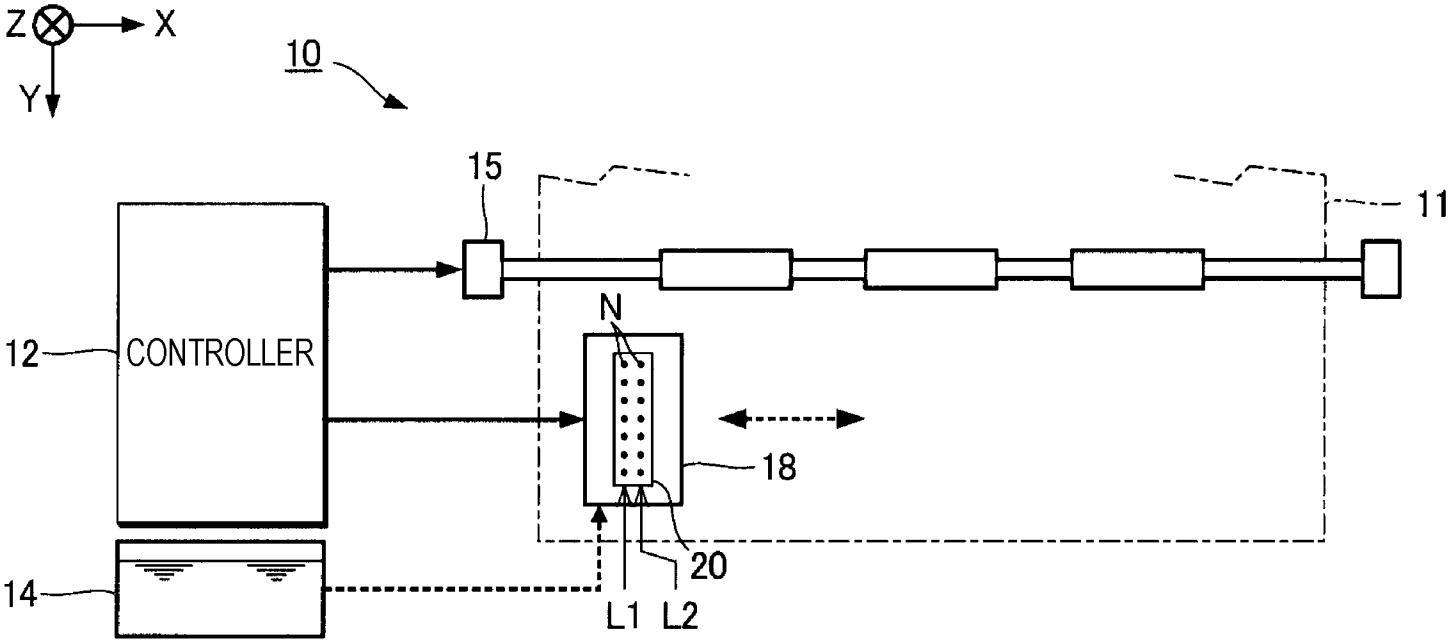
FIG. 1 illustrates a liquid ejecting apparatus according to a first embodiment.

FIG. 1 illustrates a partial configuration of a liquid ejecting apparatus 10 according to a first embodiment of the invention. The liquid ejecting apparatus 10 according to the first embodiment is an ink jet printer that ejects ink (an exemplary liquid) onto a medium 11, such as a print sheet. The liquid ejecting apparatus 10 illustrated in FIG. 1 includes a controller 12, a transport mechanism 15, a carriage 18, and a head unit 20. The liquid ejecting apparatus 10 is provided with a liquid container 14 that stores ink.

The liquid container 14 is an ink tank cartridge having a box shape and is detachably attached to the body of the liquid ejecting apparatus 10. The liquid container 14 may also be an ink pack cartridge having a pouch shape other than the box shape. The liquid container 14 stores ink. The ink may be black ink or color ink. The ink stored in the liquid container 14 is pumped to the head unit 20.

The controller 12 comprehensively controls all components of the liquid ejecting apparatus 10. The transport mechanism 15 transports the medium 11 in the Y direction under the control of the controller 12. The head unit 20 ejects ink supplied from the liquid container 14 onto the medium 11 from individual nozzles N under the control of the controller 12.

The head unit 20 is mounted on the carriage 18. Although FIG. 1 illustrates a single head unit 20 mounted on the carriage 18, this configuration should not be construed as limiting the invention. Two or more head units 20 may also be mounted on the carriage 18. The controller 12 causes the carriage 18 to reciprocate in the X direction, which intersects the Y direction and which, in FIG. 1, is orthogonal to the Y direction. The head unit 20 ejects ink onto the medium 11 in parallel with the transport of the medium 11 and with the reciprocation of the carriage 18 to form a desired image on the surface of the medium 11. Alternatively, two or more head units 20 may be mounted on the carriage 18. It should be noted that the direction orthogonal to the XY plane (parallel to the surface of the medium 11) is defined as the Z direction.

Figure 2:
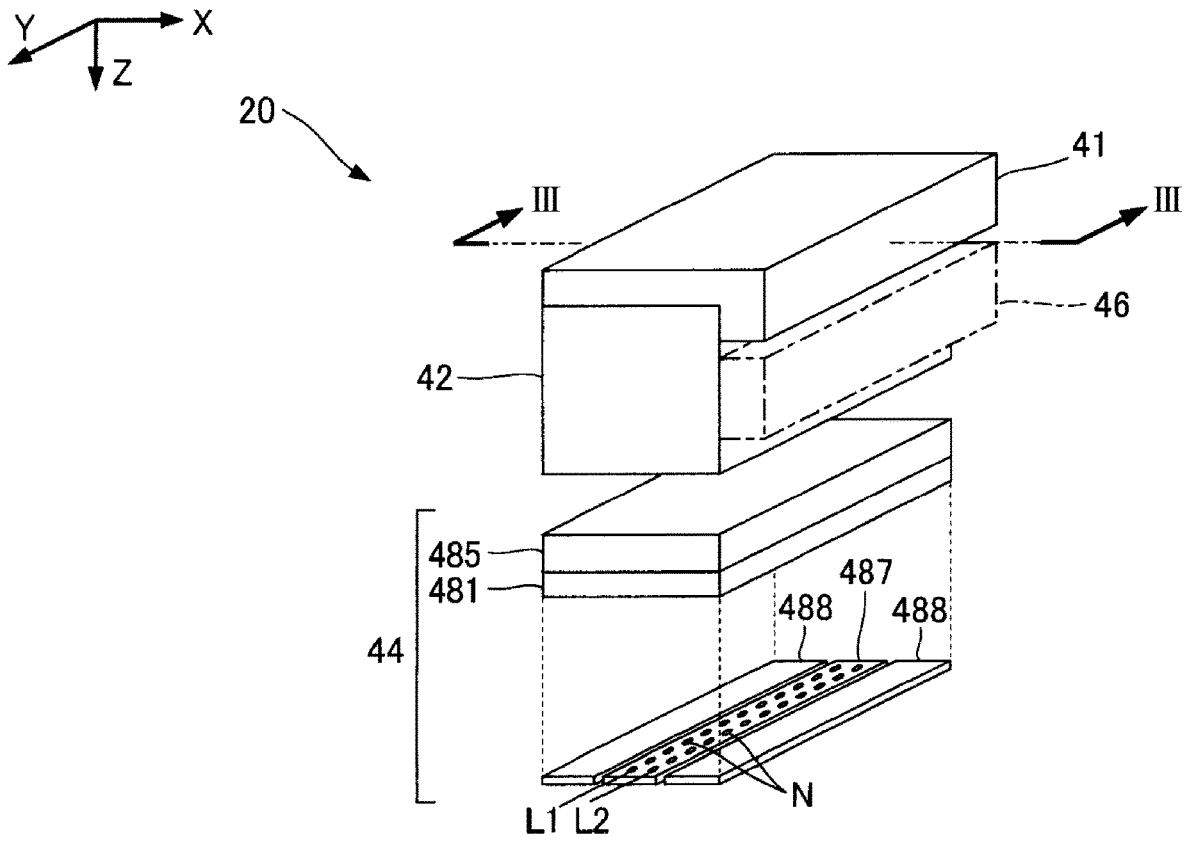
FIG. 2 is an exploded perspective view of a head unit.
Figure 3:
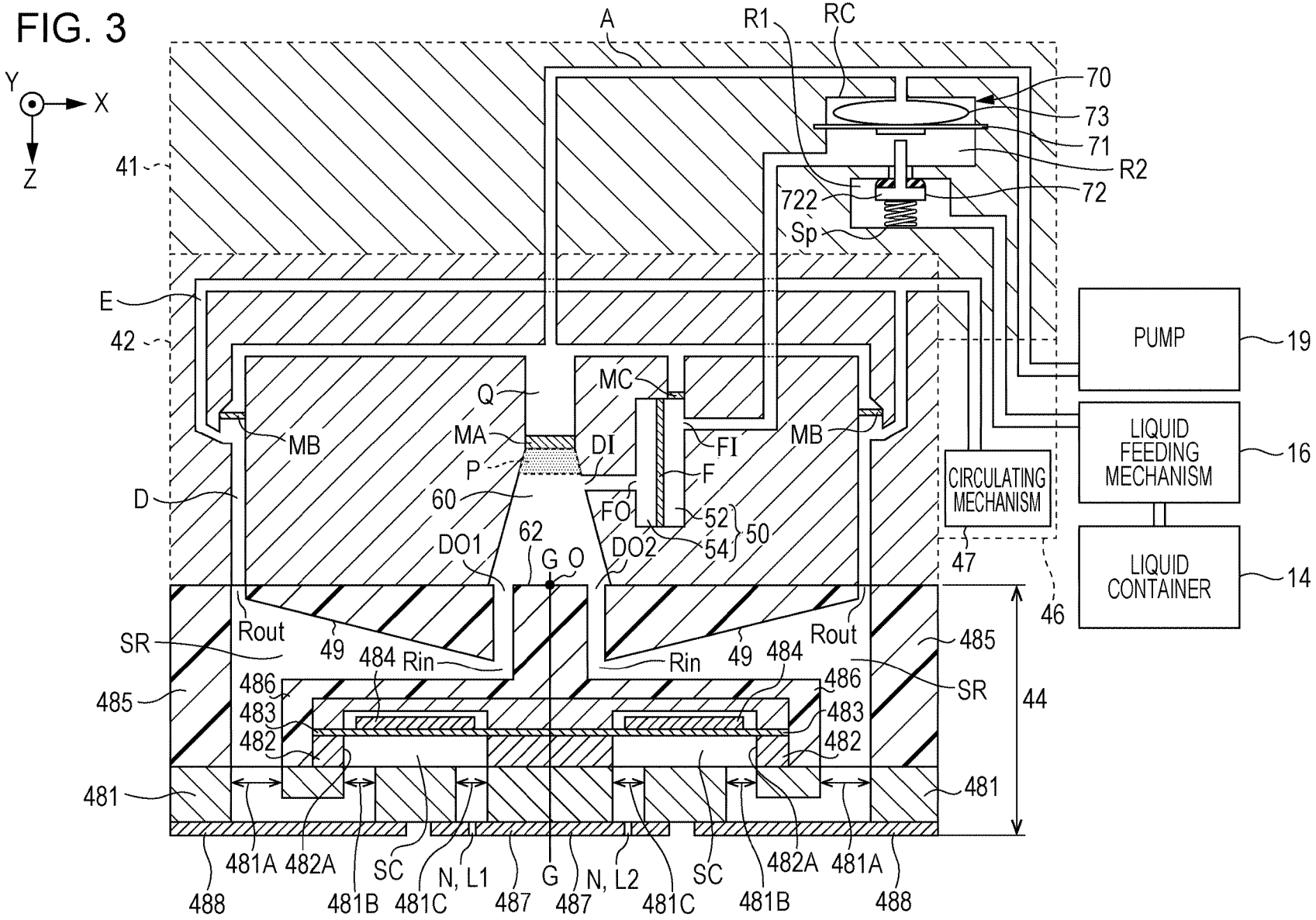
FIG. 3 is a sectional view of the head unit taken along line III-III in FIG. 2.

FIG. 2 is an exploded perspective view of the head unit 20. FIG. 3 is a sectional view of the head unit 20 taken along line III-III in FIG. 2. With reference to FIGS. 2 and 3, the head unit 20 includes a valve mechanism unit 41, a channel unit 42, a liquid ejecting head 44, and a channel component 46. The liquid ejecting head 44 ejects ink from the nozzles N. The channel unit 42 includes a liquid path D for supplying ink from the valve mechanism unit 41 to the liquid ejecting head 44. The liquid ejecting head 44 ejects ink, which is supplied from the liquid container 14 through the channel component 46 and the channel unit 42, onto the medium 11. The valve mechanism unit 41 includes an on-off valve 72 (described below) for controlling the opening and closing of the liquid path D for ink supplied from the channel component 46. The valve mechanism unit 41 is provided on the channel unit 42 such that a part of the valve mechanism unit 41 protrudes from a side surface of the channel unit 42 in the X direction. The channel component 46 faces this surface of the channel unit 42. The top surface of the channel component 46 and the bottom surface of the valve mechanism unit 41 face each other while being spaced from each other in the Z direction. The liquid path D inside the channel component 46 is in communication with the liquid path D inside the valve mechanism unit 41.

The liquid ejecting head 44 includes a channel defining substrate 481. The liquid ejecting head 44 further includes a pressure chamber defining substrate 482, a diaphragm 483, piezoelectric elements 484, a housing 485, and a sealing plate 486 on one side of the channel defining substrate 481. The liquid ejecting head 44 further includes a nozzle plate 487 and buffer plates 488 on the other side of the channel defining substrate 481. Each of the channel defining substrate 481, the pressure chamber defining substrate 482, and the nozzle plate 487 is composed of a silicon plate, for example. The housing 485 is fabricated by injection molding of a resin material, for example. The nozzles N are provided in the nozzle plate 487. The surface of the nozzle plate 487 on the opposite side of the channel defining substrate 481 corresponds to an ejection surface (the surface of the liquid ejecting head 44 that faces the medium 11).

The nozzles N are divided into a first nozzle array L1 and a second nozzle array L2. Each of the first nozzle array L1 and the second nozzle array L2 is a group of nozzles N arranged in the Y direction. The first nozzle array L1 and the second nozzle array L2 are spaced from each other in the X direction. The positions of the individual nozzles N of the first nozzle array L1 may be displaced from the positions of the corresponding nozzles N of the second nozzle array L2 in the Y direction (to achieve a zigzag or staggered arrangement).

With reference to FIG. 3, the liquid ejecting head 44 according to the embodiment has a structure associated with the first nozzle array L1 (the left-hand side of FIG. 3) and a structure associated with the second nozzle array L2 (the right-hand side of FIG. 3), which are substantially symmetrical to each other about an imaginary line G-G extending in the Z direction and which are substantially identical to each other. Accordingly, the following description focuses mainly on the structure associated with the first nozzle array L1 (the left side of the imaginary line G-G in FIG. 3).

The channel defining substrate 481 has an opening 481A, branch channels 481B, and communication channels 481C. The branch channels 481B and the communication channels 481C are through holes corresponding to the individual nozzles N. The opening 481A is continuous across the array of the nozzles N. The buffer plate 488 is a compliance substrate provided to the surface of the channel defining substrate 481 on the opposite side of the pressure chamber defining substrate 482 and covers the opening 481A. The pressure fluctuation in the opening 481A is absorbed by the buffer plates 488.

The housing 485 includes a common liquid chamber (reservoir) SR in communication with the opening 481A of the channel defining substrate 481. The common liquid chamber SR on the left-hand side of FIG. 3 is a space for storing ink to be supplied to the nozzles N of the first nozzle array L1 and is continuous across these nozzles N. In contrast, the common liquid chamber SR on the right-hand side of FIG. 3 is a space for storing ink to be supplied to the nozzles N of the second nozzle array L2 and is continuous across these nozzles N. Each of the common liquid chambers SR has an inlet Rin into which ink flows from the upstream side.

The pressure chamber defining substrate 482 has openings 482A corresponding to the individual nozzles N. The diaphragm 483 is a plate capable of elastic deformation and is disposed on the surface of the pressure chamber defining substrate 482 on the opposite side of the channel defining substrate 481. The space inside each opening 482A of the pressure chamber defining substrate 482 defined between the diaphragm 483 and the channel defining substrate 481 functions as a pressure chamber (cavity) SC. The ink supplied from the common liquid chamber SR through the corresponding branch channel 481B is charged into the pressure chamber SC. Each of the pressure chambers SC is in communication with the corresponding nozzle N through the communication channel 481C of the channel defining substrate 481.

The piezoelectric elements 484 are disposed on the surface of the diaphragm 483 on the opposite side of the pressure chamber defining substrate 482 so as to correspond to the individual nozzles N. Each of the piezoelectric elements 484 is a driving element composed of mutually opposed electrodes holding a piezoelectric body therebetween. If the piezoelectric element 484 deforms in response to supply of a driving signal, the diaphragm 483 oscillates. This oscillation varies the pressure in the pressure chamber SC and causes the ink in the pressure chamber SC to be ejected from the nozzle N. The sealing plate 486 protects the piezoelectric elements 484. The piezoelectric elements 484 are connected to the controller 12 via, for example, a flexible printed circuit (FPC) or a chip-on-film (COF) (which are not shown).

The valve mechanism unit 41 and the channel unit 42 function as a channel structure including the liquid path D and an air path A. The valve mechanism unit 41 includes a valve mechanism 70 (self-sealing valve). The channel unit 42 includes a filter chamber 50 and a liquid storing chamber 60. The liquid path D is used to supply ink from the liquid container 14 to the nozzles N of the liquid ejecting head 44. The valve mechanism 70, the filter chamber 50, and the liquid storing chamber 60 are provided in the order mentioned from the upstream side to the downstream side of the liquid path D. The liquid ejecting head 44 is disposed downstream of the liquid storing chamber 60. The air path A is in communication with a compression chamber RC for controlling the valve mechanism 70 of the liquid path D and in communication with a degassing chamber Q for degassing the ink (removing bubbles from ink) in the liquid path D with gas permeable films MA, MB, and MC.

The valve mechanism 70 includes an upstream path R1, a downstream path R2, and the compression chamber RC that constitute a part of the liquid path D. The upstream path R1 is connected to a liquid feeding mechanism 16 through the channel component 46. The liquid feeding mechanism 16 supplies (that is, pumps) ink stored in the liquid container 14 to the head unit 20 in a compressed state. The on-off valve 72 is disposed between the upstream path R1 and the downstream path R2. The downstream path R2 and the compression chamber RC hold a flexible film 71 therebetween.

The on-off valve 72 opens or closes the liquid path D for supplying ink to the liquid ejecting head 44. The on-off valve 72 has a valve body 722. The valve body 722 is disposed between the upstream path R1 and the downstream path R2 and connects or disconnects the upstream path R1 to or from the downstream path R2 (switches between an open state and a closed state). The valve body 722 is equipped with a spring Sp that urges the valve body 722 in the direction for disconnecting the upstream path R1 from the downstream path R2. That is, if no force is applied to the valve body 722, the upstream path R1 is disconnected from the downstream path R2. In contrast, if a certain force shifts the valve body 722 in the positive Z direction against the urging force of the spring Sp, the upstream path R1 is connected to the downstream path R2.

The compression chamber RC is provided with a pouch body 73. The pouch body 73 is a bag composed of an elastic material, such as rubber. The pouch body 73 expands in response to compression in the air path A and contracts in response to decompression in the air path A. The pouch body 73 is connected to a pump 19 through the air path A in the channel component 46. The pump 19 according to the embodiment is capable of compression and decompression in the air path A and is typically a pneumatic pump. The pump 19 may be a single pump capable of both compression and decompression or may be realized as separate pumps each respectively dedicated to compression or decompression. The pump 19 is driven by a sequence selected from multiple sequences in accordance with an instruction from the controller 12. The multiple sequences contain a compression sequence for supplying air to the air path A and a decompression sequence for evacuating air from the air path A. The compression (air supply) in the air path A in response to the compression sequence expands the pouch body 73, while the decompression (air evacuation) in the air path A in response to the decompression sequence contracts the pouch body 73.

While the pouch body 73 is in a contracted state within a certain range of pressure in the downstream path R2, the valve body 722 is urged upward (in the negative Z direction) by the spring Sp, thereby disconnecting the upstream path R1 from the downstream path R2. In contrast, if the pressure in the downstream path R2 falls below a certain threshold due to ejection of ink by the liquid ejecting head 44 or air evacuation from the outside, the valve body 722 shifts downward (in the positive Z direction) against the urging force of the spring Sp, thereby connecting the upstream path R1 to the downstream path R2. If the pouch body 73 expands in response to compression with the pump 19, the pouch body 73 pushes the flexible film 71 and the valve body 722 downward against the urging force of the spring Sp, thereby shifting the valve body 722 in the positive Z direction. The pushing of the flexible film 71 shifts the valve body 722 and thus opens the on-off valve 72. That is, the compression with the pump 19 can forcibly open the on-off valve 72 regardless of the pressure in the downstream path R2. Exemplary cases of pushing the flexible film 71 by compression with the pump 19 and forcibly opening the on-off valve 72 include a case of charging ink (hereinafter referred to as "initial charging") into the head unit 20 at the initial setting and a case of discharging ink from the nozzles N during a cleaning operation.

The filter chamber 50 is equipped with a filter F. The filter F is disposed so as to intersect the liquid path D leading to the liquid ejecting head 44 and captures bubbles and by-products contained in ink. Specifically, the filter F functions as a compartment between a space 52 and a space 54. The space 52 on the upstream side is in communication with the downstream path R2 of the valve mechanism unit 41 through an inlet FI, while the space 54 on the downstream side is in communication with the liquid storing chamber 60 through an outlet FO.

The liquid storing chamber 60 is a space for temporarily storing ink. The liquid storing chamber 60 has an inlet DI into which the ink that has passed through the filter F flows from the space 54 through the outlet FO, and outlets (a first outlet DO1 and a second outlet DO2) from which the ink flows to the nozzles N. The liquid storing chamber 60 according to the embodiment has two outlets including the first outlet DO1 in communication with the nozzles N of the first nozzle array L1 and the second outlet DO2 in communication with the nozzles N of the second nozzle array L2. Alternatively, the liquid storing chamber 60 may include two or more first outlets DO1 and two or more second outlets DO2. The first outlet DO1 and the second outlet DO2 are disposed below the inlet DI in the vertical direction (the Z direction). The first outlet DO1 and the second outlet DO2 have the same sectional shape and have substantially the same flow rate of ink.

The space inside the liquid storing chamber 60 located above the inlet DI in the vertical direction functions as a bubble retention space P. The bubble retention space P retains the bubbles (gas) that have passed through the filter F. Although the space inside the liquid storing chamber 60 located above the inlet DI in the vertical direction functions as the bubble retention space P in the embodiment, this configuration should not be construed as limiting the invention. Alternatively, a part of the space inside the liquid storing chamber 60 located above the inlet DI in the vertical direction may function as the bubble retention space P.

In the embodiment, the top of the liquid storing chamber 60 in the vertical direction is in communication with the degassing chamber Q. The degassing chamber Q is a space for decompressing a part of the liquid path D to thereby remove bubbles from ink. The degassing chamber Q also functions as a degassing space where the bubbles (gas) removed from the ink are temporarily retained.

The gas permeable films MA, MB, and MC function as compartments at different positions between the degassing chamber Q and the liquid path D. The positions and number of gas permeable films illustrated in the embodiment should not be construed as limiting the invention. For example, a single gas permeable film may be disposed only at a certain position in the liquid path D (for example, at the illustrated position of the gas permeable film MA). The gas permeable film MA is disposed between the liquid storing chamber 60 and the degassing chamber Q. Each of the gas permeable films MB is disposed between the corresponding common liquid chamber SR and the degassing chamber Q. The gas permeable film MC is disposed between the space 52 and the degassing chamber Q.

Each of the gas permeable films MA, MB, and MC is a film having gas permeability to allow air and other gases but not liquid (for example, ink) to pass therethrough. The gas permeable films MA, MB, and MC are composed of a known polymeric material, for example. The bubbles captured by the filter F are discharged to the degassing chamber Q through the gas permeable film MC and are thus removed from the ink. The bubbles that have passed through the filter F enter the liquid storing chamber 60 from the space 54 through the inlet DI. Then, the bubbles that have entered the liquid storing chamber 60 are also discharged to the degassing chamber Q through the gas permeable film MA.

Each of the common liquid chambers SR has an outlet Rout. The outlet Rout is disposed on a ceiling 49 of the common liquid chamber SR. The ceiling 49 of the common liquid chamber SR is a slanted surface (flat or curved surface) inclined upward from the side of the inlet Rin to the side of the outlet Rout. This slanted ceiling 49 guides the bubbles that have entered through the inlet Rin to the outlet Rout and causes the bubbles to be discharged to the degassing chamber Q through the gas permeable film MB.

The decompression in the air path A with the pump 19 results in decompression in the degassing chamber Q because the degassing chamber Q is in communication with the air path A. The decompression in the degassing chamber Q causes the bubbles in the liquid path D to pass through the gas permeable film MA, MB, or MC. The gas that has been introduced into the degassing chamber Q through the gas permeable film MA, MB, or MC is discharged to the outside of the apparatus through the air path A. The bubbles are thus removed from the liquid path D.

The liquid path D according to the embodiment is provided with a liquid path E for returning the ink in the liquid ejecting head 44 to the side of the liquid ejecting apparatus 10. The liquid path E is in communication with the internal path in the channel unit 42 for supplying ink to the liquid ejecting head 44. Specifically, the liquid path E is in communication with the outlets Rout of the common liquid chambers SR of the liquid ejecting head 44. The liquid path E is connected to a circulating mechanism 47 through the channel component 46. The circulating mechanism 47 includes a circulating path and a pump, for example. The circulating mechanism 47 has a circulating function of returning the ink discharged along the liquid path E to the side of the liquid ejecting apparatus 10, so that the ink can be reused in the liquid ejecting head 44.

In the above-described configuration illustrated in FIG. 3, when the valve body 722 of the valve mechanism 70 opens, the ink from the liquid container 14 flows through the filter chamber 50 and enters the liquid storing chamber 60 through the inlet DI. The ink exits the liquid storing chamber 60 through one or both of the first outlet DO1 and the second outlet DO2. In the case of ink ejection by driving the piezoelectric elements 484 associated with the first nozzle array L1, the ink in the liquid storing chamber 60 flows into the common liquid chamber SR associated with the first nozzle array L1 through the first outlet DO1, is supplied to the individual pressure chambers SC through the opening 481A, and is then ejected from the nozzles N of the first nozzle array L1. In the case of ink ejection by driving the piezoelectric elements 484 associated with the second nozzle array L2, the ink in the liquid storing chamber 60 flows into the common liquid chamber SR associated with the second nozzle array L2 through the second outlet DO2, is supplied to the individual pressure chambers SC through the opening 481A, and is then ejected from the nozzles N of the second nozzle array L2.

Most of the bubbles contained in ink are captured by the filter F but some may pass through the filter F. In the embodiment, the liquid storing chamber 60 disposed downstream of the filter F can receive the bubbles through the inlet DI that have passed through the filter F. These bubbles in the liquid storing chamber 60 rise due to buoyancy and are retained in the bubble retention space P. The configuration according to the embodiment can cause the bubbles that have passed through the filter F to be retained in the bubble retention space P and thus suppress the bubbles from flowing into the liquid ejecting head 44 and its nozzles N through the first outlet DO1 or the second outlet DO2.

Some types of ink, however, often generate by-products (for example, an aggregate of a pigment and a binder resin) due to evaporation of the solvent of the ink, for example, at the air-liquid interface where the ink is in contact with the bubbles retained in the bubble retention space P. For example, types of ink having a high solid content concentration readily generate solid materials due to evaporation of the ink solvent. In addition, types of quick-drying ink applicable to a medium 11 (for example, a plastic film) having a low ink absorption property, other than a medium 11 (for example, a paper sheet) having a high ink absorption property, also readily generate solid materials because of the quick-drying property of the ink solvent. As the specific gravity of a by-product generated in the bubble retention space P increases above the specific gravity of the solvent, the by-product more readily sinks below the bubble retention space P and is accumulated on a bottom 62 of the liquid storing chamber 60. In particular, types of ink containing pigments having bright and durable colors generate solid materials that are readily accumulated because the pigments tend to have a higher specific gravity than that of the ink solvent.

The filter F can remove the by-products generated upstream of the filter F (for example, in the space 52) but cannot remove the by-products generated in the bubble retention space P downstream of the filter F. Such remaining by-products may enter the liquid ejecting head 44 and its nozzles N, resulting in irregular ejection.

To solve this problem, the liquid storing chamber 60 according to the embodiment has the first outlet DO1 and the second outlet DO2 on both sides of an imaginary center line O'-O' illustrated in FIG. 4 (described below) as viewed in the vertical direction (Z direction). The imaginary center line O'-O' is a straight line extending in the Y direction and passing through a center O of a projected area P', which is defined by projecting the bubble retention space P onto the bottom 62 of the liquid storing chamber 60 in the vertical direction. It should be noted that the imaginary center line O'-O' is not necessarily a straight line extending in the Y direction. In this configuration, the ink exits the liquid storing chamber 60 through the first outlet DO1 and the second outlet DO2, thereby generating ink flows having components in the opposite directions from the imaginary center line O'-O' of the projected area P' to the first outlet DO1 and the second outlet DO2. The ink flow components in the opposite directions cancel movements of the by-products accumulated in the projected area P' and thus suppress the by-products from reaching the first outlet DO1 or the second outlet DO2. Accordingly, the configuration according to the embodiment can suppress the by-products generated in the bubble retention space P downstream of the filter F from flowing into the liquid ejecting head 44 and its nozzles N through the first outlet DO1 or the second outlet DO2.

The configuration according to the embodiment will now be described in detail with reference to the accompanying drawings. FIG. 4 illustrates sections of the liquid storing chamber 60 illustrated in FIG. 3. The upper half of FIG. 4 is a sectional view of the filter chamber 50 and the liquid storing chamber 60 taken along the XZ plane, while the lower half is a sectional view taken along line IV-IV in the upper sectional view. With reference to FIG. 4, the liquid storing chamber 60 is disposed downstream of the filter chamber 50. The bubble retention space P of the liquid storing chamber 60 is located above the inlet DI in the vertical direction. The bottom 62 of the liquid storing chamber 60 is located below the bubble retention space P in the vertical direction. In the lower sectional view of FIG. 4, the projected area P' is defined by projecting the bubble retention space P onto the bottom 62 in the vertical direction. The first outlet DO1 is located on one side (the negative side in the X direction) of the imaginary center line O'-O' passing through the center O of the projected area P', while the second outlet DO2 is located on the other side (the positive side in the X direction) of the imaginary center line O'-O'.

Figure 4:
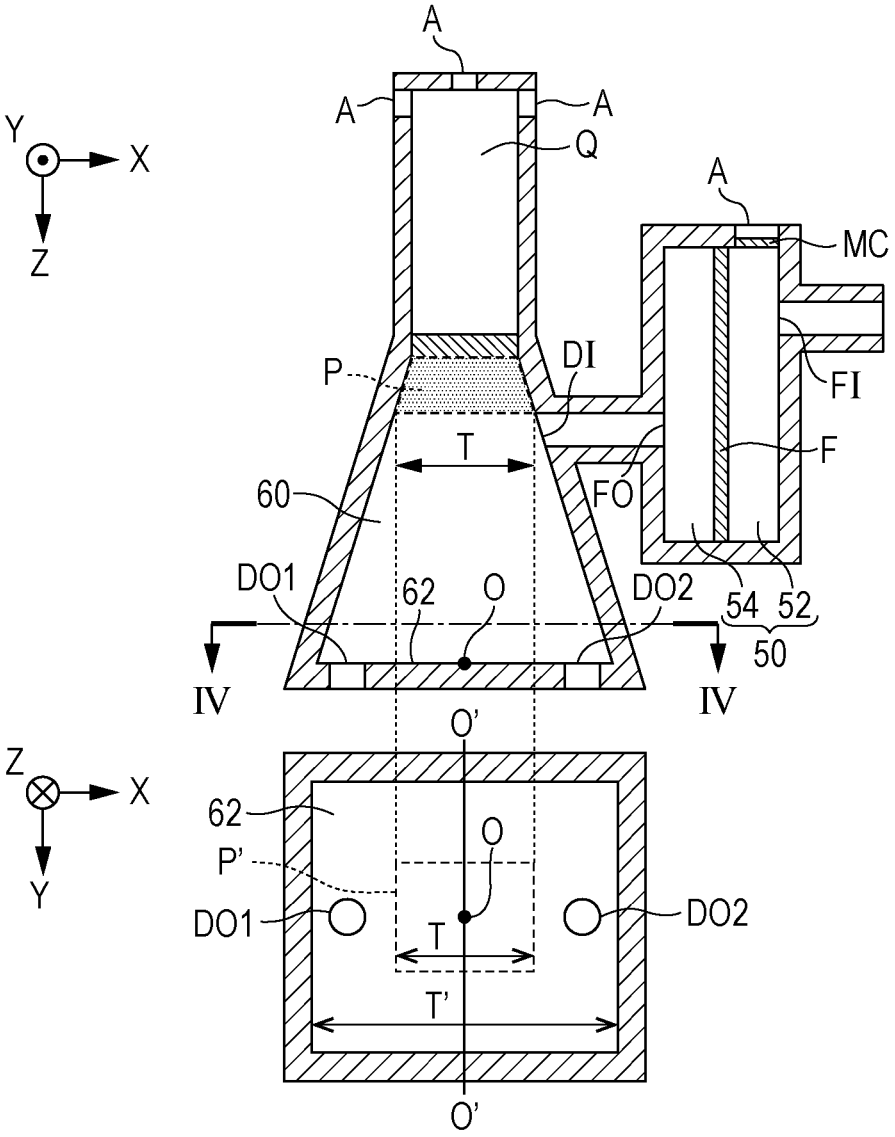
FIG. 4 illustrates sections of a filter chamber and a liquid storing chamber.

With reference to FIG. 4, the first outlet DO1 and the second outlet DO2 are located outside the projected area P'. This arrangement can suppress the by-products sinking from the bubble retention space P from reaching the first outlet DO1 or the second outlet DO2. The arrangement can thus suppress the by-products generated in the bubble retention space P downstream of the filter F from flowing into the liquid ejecting head 44 and its nozzles N through the first outlet DO1 or the second outlet DO2. It should be noted that the arrangement illustrated in FIG. 4 is a mere example. The first outlet DO1 and the second outlet DO2 may also be located inside the projected area P'.

In the embodiment, the first outlet DO1 and the second outlet DO2 are located on both sides of the imaginary center line O'-O' passing through the center O of the projected area P'. This arrangement can readily generate ink flow components in the opposite directions. The ink flow components in the opposite directions cancel movements of the by-products that have sunk from the bubble retention space P onto the bottom 62 and been accumulated in the projected area P' and thus suppress the by-products from reaching the first outlet DO1 or the second outlet DO2. This configuration can thus suppress the by-products from flowing into the liquid ejecting head 44 and its nozzles N. In the configuration illustrated in FIG. 4, the direction from the center O of the projected area P' to the second outlet DO2 is opposite to the direction from the center O of the projected area P' to the first outlet DO1, as viewed in the vertical direction. The first outlet DO1 and the second outlet DO2 are thus symmetrical to each other about the imaginary center line O'-O'. This arrangement can readily generate ink flow components in the opposite directions from the center O of the projected area P', thereby effectively suppressing the by-products accumulated in the projected area P' from reaching the first outlet DO1 or the second outlet DO2.

The liquid storing chamber 60 illustrated in FIG. 4 has a section that is orthogonal to the vertical direction of the liquid storing chamber 60 and is located below the bubble retention space P in the vertical direction. This cross section has a smaller area than that of the bottom 62. Although the liquid storing chamber 60 illustrated in FIG. 4 has a truncated pyramid shape of which the rectangular section orthogonal to the vertical direction becomes larger in the positive Z direction, this configuration should not be construed as limiting the invention. For example, the liquid storing chamber 60 may also have a truncated triangular pyramid shape having a triangular section or a truncated cone shape having a circular section.

Since the liquid storing chamber 60 has a section located below the bubble retention space P in the vertical direction and having a smaller area than that of the bottom 62, the projected area P' of the bubble retention space P can have a smaller area T than the area T' of the bottom 62. This configuration can cause the by-products sinking from the bubble retention space P to be readily accumulated in the vicinity of the center O of the projected area P'. That is, the configuration can keep the by-products accumulated in the projected area P' away from the first outlet DO1 and the second outlet DO2, thereby suppressing the by-products from flowing out through the first outlet DO1 or the second outlet DO2.

In the embodiment, the first outlet DO1 and the second outlet DO2 are located below the inlet DI in the vertical direction. This configuration can provide a larger bubble retention space P and can more readily guide bubbles into the bubble retention space P using buoyancy, compared with the configuration including the first outlet DO1 and the second outlet DO2 located above the inlet DI. Furthermore, the first outlet DO1 and the second outlet DO2 are located below the center of the liquid storing chamber 60 in the vertical direction in the embodiment. This configuration can provide a larger bubble retention space P and can more readily guide bubbles into the bubble retention space P using buoyancy, compared with the configuration including the first outlet DO1 and the second outlet DO2 located above the center of the liquid storing chamber 60.

Figure 5:
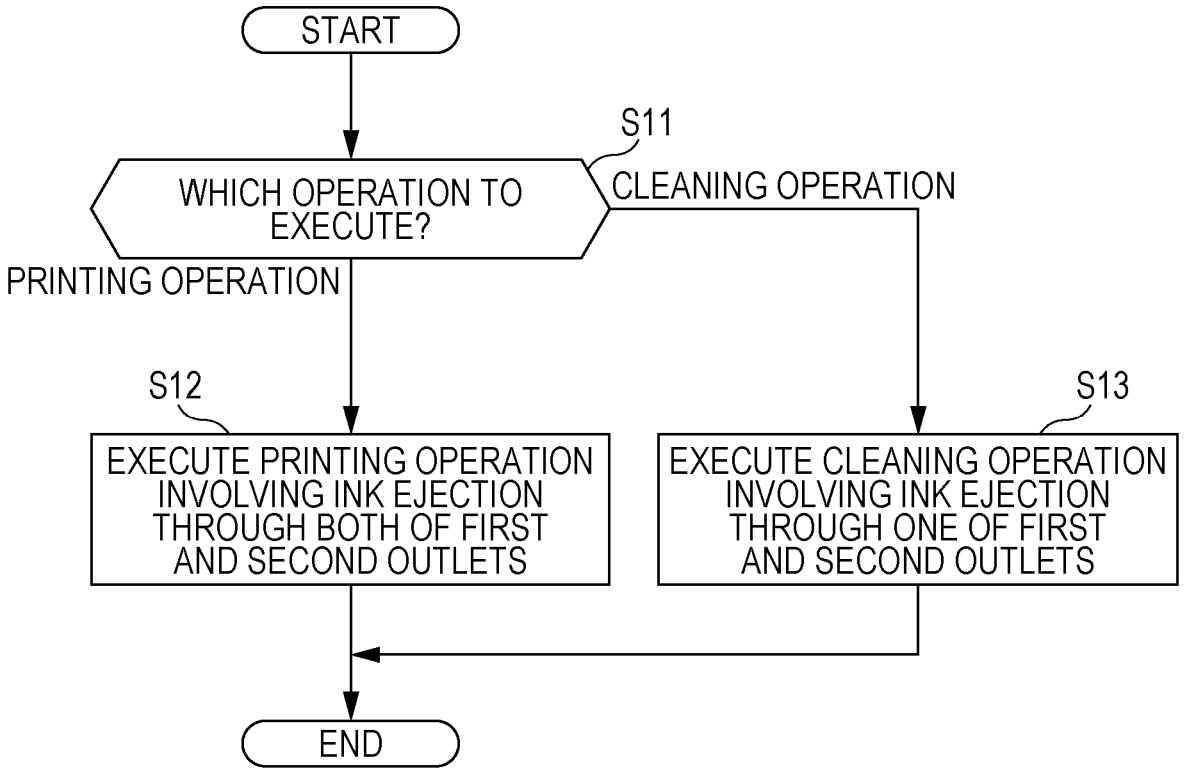
FIG. 5 is a flowchart illustrating a method of driving the liquid ejecting apparatus.
Figure 6:
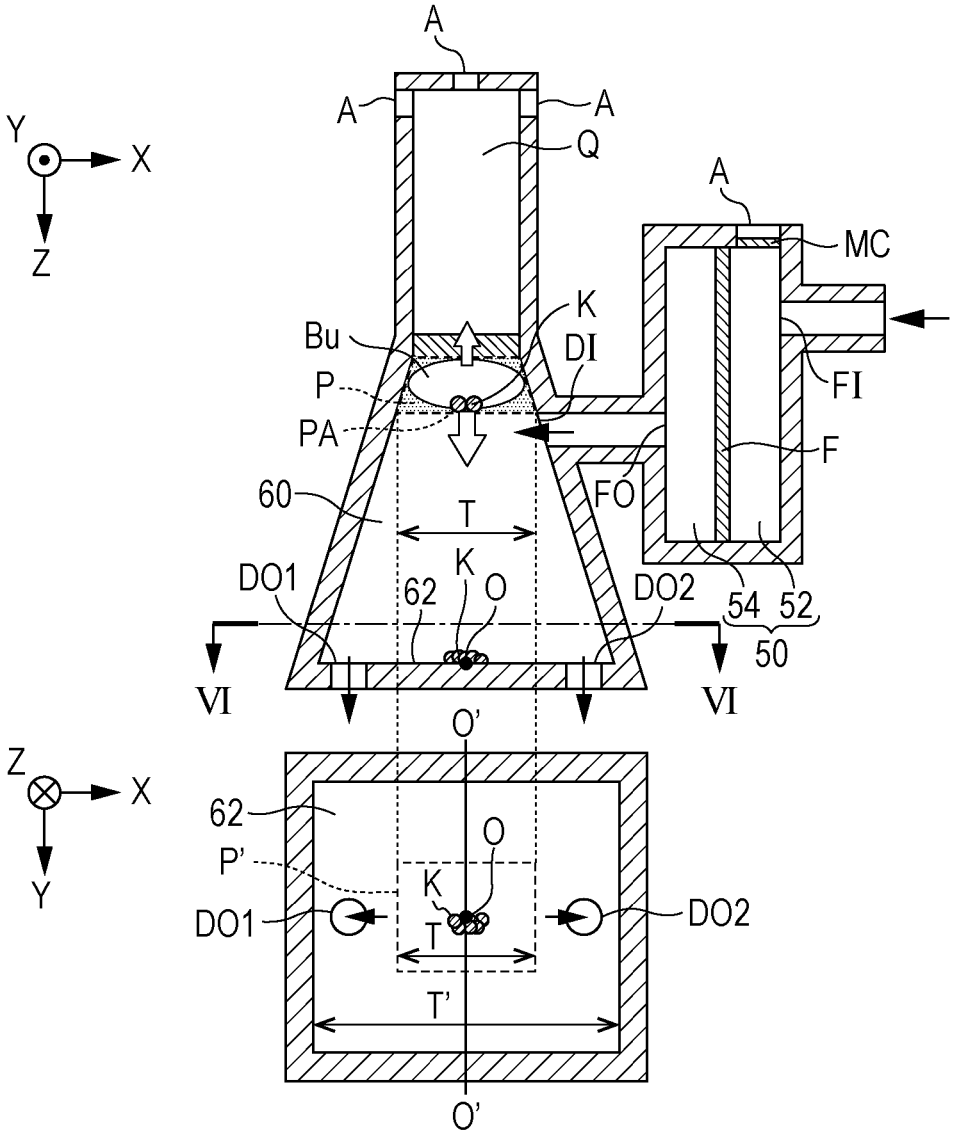
FIG. 6 illustrates a process in the liquid storing chamber during a printing operation.
Figure 7:
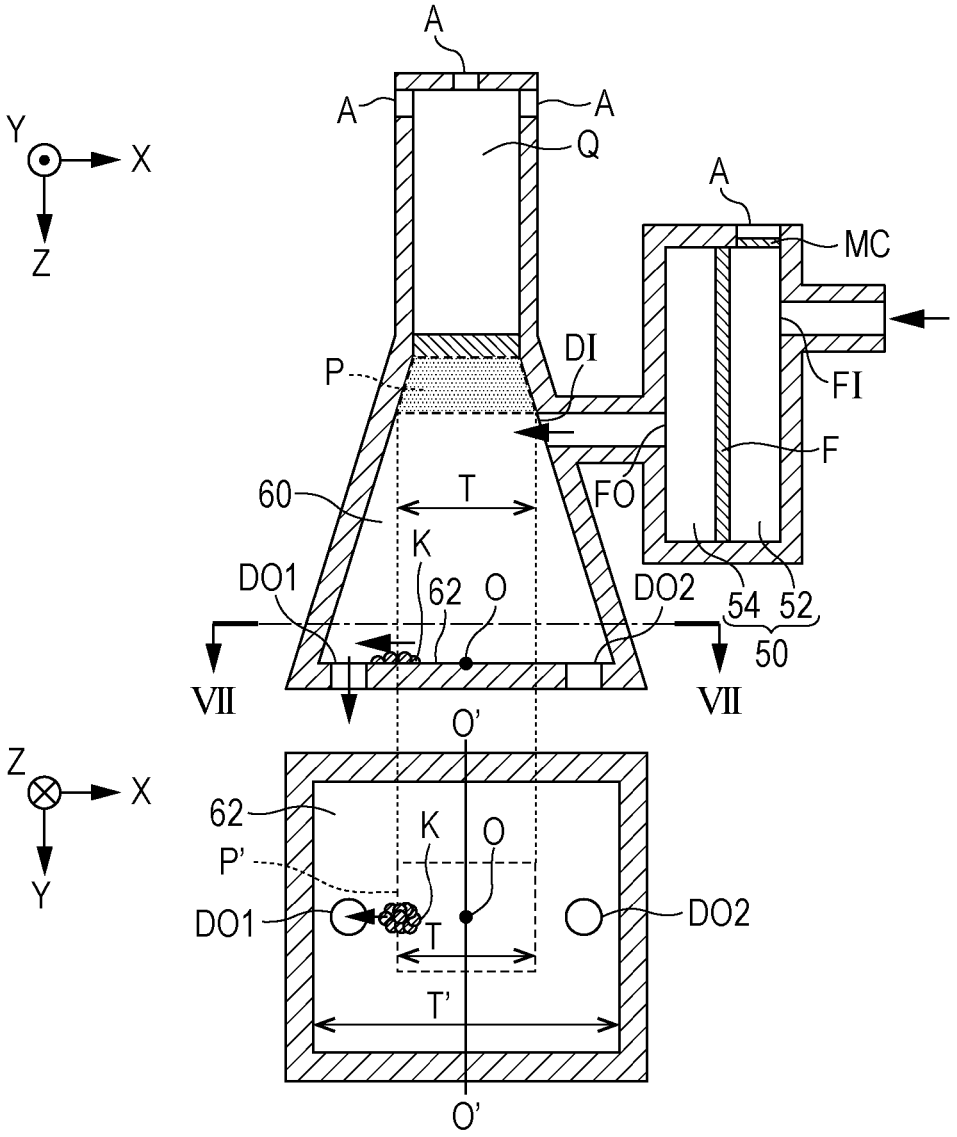
FIG. 7 illustrates a process in the liquid storing chamber during a cleaning operation.

A method of driving the liquid ejecting apparatus 10 according to the first embodiment will now be explained with reference to the accompanying drawings. FIG. 5 is a flowchart illustrating a method of driving the liquid ejecting apparatus 10 during a printing operation and a cleaning operation. The cleaning operation indicates a maintenance operation for discharging the by-products accumulated on the bottom 62 of the liquid storing chamber 60 from the nozzles N of the liquid ejecting head 44. FIG. 6 illustrates a process in the liquid storing chamber 60 during the printing operation. The upper half of FIG. 6 is a sectional view of the filter chamber 50 and the liquid storing chamber 60 taken along the XZ plane, while the lower half is a sectional view taken along line VI-VI in the upper sectional view. FIG. 7 illustrates a process in the liquid storing chamber 60 during the cleaning operation. The upper half of FIG. 7 is a sectional view of the filter chamber 50 and the liquid storing chamber 60 taken along the XZ plane, while the lower half is a sectional view taken along line VII-VII in the upper sectional view.

With reference to FIG. 5, the controller 12 determines which operation (the printing operation or the cleaning operation) to execute next in Step S11. If the controller 12 determines to execute the printing operation next in Step S11, the printing operation involving ink ejection through both of the first outlet DO1 and the second outlet DO2 is executed in Step S12. Specifically, the controller 12 selectively supplies driving pulses to the piezoelectric elements 484 associated with the first nozzle array L1 and the second nozzle array L2 in accordance with received print data. Then, as indicated by solid arrows in FIG. 6, the ink that has passed through the filter F and entered the liquid storing chamber 60 flows into the liquid ejecting head 44 and its nozzles N through both of the first outlet DO1 and the second outlet DO2 and is then ejected from the nozzles N of the first nozzle array L1 and the second nozzle array L2.

The bubbles Bu that have passed through the filter F enter the liquid storing chamber 60 through the inlet DI, rise due to buoyancy, and are then retained in the bubble retention space P. These bubbles Bu retained in the bubble retention space P and ink form an air-liquid interface PA in the bubble retention space P. If by-products K are generated at the air-liquid interface PA, as illustrated in the upper sectional view of FIG. 6, the by-products K sink onto the bottom 62 and are accumulated in the projected area P', as illustrated in the lower sectional view of FIG. 6.

In the embodiment, the ink flows out through the first outlet DO1 and the second outlet DO2, thereby generating ink flows having components in the opposite directions from the imaginary center line O'-O' of the projected area P' to the first outlet DO1 and the second outlet DO2 (as indicated by solid arrows in the lower sectional view of FIG. 6). The ink flow components in the opposite directions cancel movements of the by-products K accumulated in the projected area P' and thus suppress the by-products K from reaching the first outlet DO1 or the second outlet DO2. This configuration can thus suppress the by-products K from flowing into the liquid ejecting head 44 and its nozzles N through the first outlet DO1 or the second outlet DO2.

In the embodiment, the degassing chamber Q is disposed above the bubble retention space P in the vertical direction and degases the liquid with the gas permeable film MA. This configuration can cause the bubbles Bu retained in the bubble retention space P to be discharged to the degassing chamber Q. The configuration can thus reduce the generation of by-products K at the air-liquid interface PA between the bubbles Bu and the ink in the bubble retention space P. In addition, the projected area P' of the air-liquid interface PA gradually becomes smaller during discharge of the bubbles Bu from the liquid storing chamber 60 according to the embodiment. This configuration can keep the by-products K generated at the air-liquid interface PA further away from the first outlet DO1 and the second outlet DO2.

If the controller 12 determines to execute the cleaning operation next in Step S11, the cleaning operation involving ink ejection through one of the first outlet DO1 and the second outlet DO2 is executed in Step S13. Specifically, the nozzles N on the ejection surface of the liquid ejecting head 44 are capped with a cap (not shown) and then vacuumed using a pump (not shown).

For example, only the first nozzle array L1 is capped without the capping of the second nozzle array L2, so that the ink flows out through the first outlet DO1. This process generates only an ink flow from the center O of the projected area P' to the first outlet DO1, as indicated by solid arrows in FIG. 7. This ink flow brings the by-products K accumulated in the projected area P' to the first outlet DO1 to be discharged.

Alternatively, only the second nozzle array L2 may be capped without the capping of the first nozzle array L1, so that the ink flows out through the second outlet DO2. This process generates only an ink flow from the center O of the projected area P' to the second outlet DO2. This ink flow brings the by-products K accumulated in the projected area P' to the second outlet DO2 to be discharged.

Figure 8:
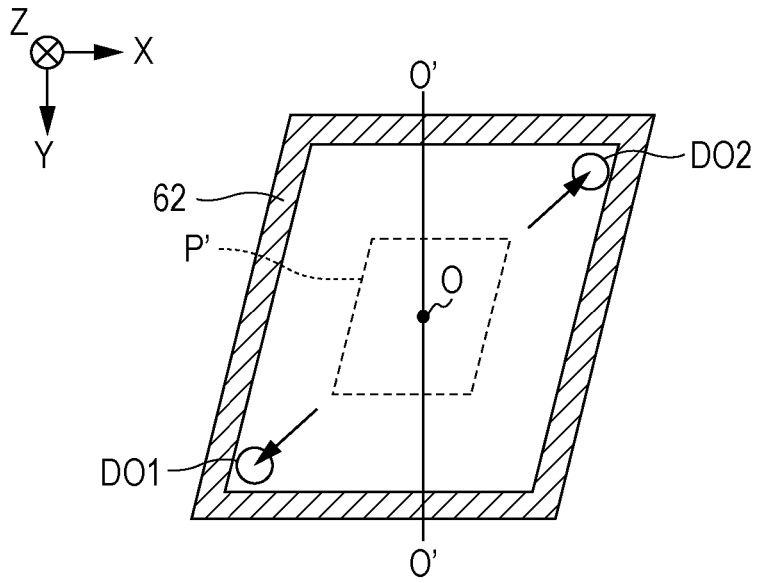
FIG. 8 is a sectional view for illustrating the bottom of a liquid storing chamber according to a first modification of the first embodiment.

Although the bottom 62 of the liquid storing chamber 60 has a rectangular shape in the first embodiment, this configuration should not be construed as limiting the invention. For example, with reference to FIG. 8, the bottom 62 of the liquid storing chamber 60 may have a rhombus shape. FIG. 8 is a sectional view for illustrating the bottom 62 of the liquid storing chamber 60 according to a first modification of the first embodiment. The rhombus bottom 62 illustrated in FIG. 8 may have a first outlet DO1 and a second outlet DO2 each of which is located at one of opposite vertices of the rhombus bottom 62. The first outlet DO1 and the second outlet DO2 can thus be located away from the projected area P'.

In the configuration illustrated in FIG. 8, the ink flows out through the first outlet DO1 and the second outlet DO2, thereby generating ink flows having components in the opposite directions from the imaginary center line O'-O' of the projected area P' to the first outlet DO1 and the second outlet DO2. The ink flow components in the opposite directions cancel movements of the by-products accumulated in the projected area P' and thus suppress the by-products from reaching the first outlet DO1 or the second outlet DO2. This configuration can suppress the by-products from flowing into the liquid ejecting head 44 and its nozzles N.

Figure 9:
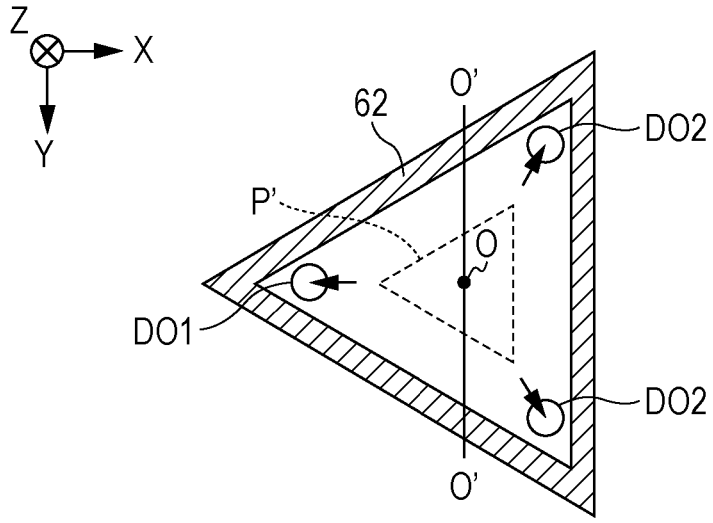
FIG. 9 is a sectional view for illustrating the bottom of a liquid storing chamber according to a second modification of the first embodiment.

Alternatively, with reference to FIG. 9, the liquid storing chamber 60 may have a truncated triangular pyramid shape having a triangular bottom 62. FIG. 9 is a sectional view for illustrating the bottom 62 of the liquid storing chamber 60 according to a second modification of the first embodiment. The triangular bottom 62 illustrated in FIG. 9 may have a first outlet DO1 located at the vertex on one side of the imaginary center line O'-O' and two second outlets DO2 located at the two respective vertices on the other side. That is, the bottom 62 has one first outlet DO1 and two second outlets DO2. The first outlet DO1 and the second outlets DO2 can thus be located away from the projected area P'.

In the configuration illustrated in FIG. 9, the ink flows out through the first outlet DO1 and the second outlets DO2, thereby generating ink flows having components in different directions from the imaginary center line O'-O' of the projected area P' to the first outlet DO1 and the second outlets DO2. The ink flow components in different directions cancel movements of the by-products accumulated in the projected area P' and thus suppress the by-products from reaching the first outlet DO1 or the second outlet DO2. This configuration can suppress the by-products from flowing into the liquid ejecting head 44 and its nozzles N.

Second Embodiment

Figure 10:
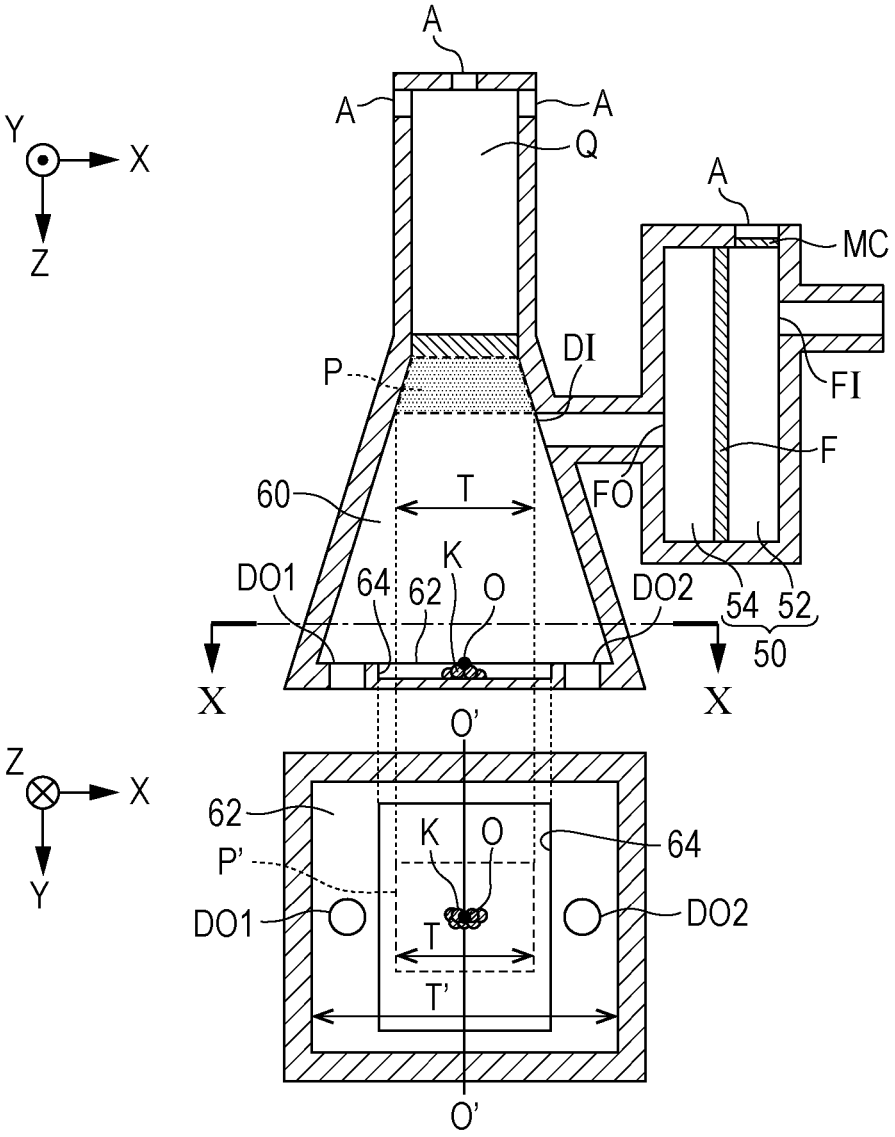
FIG. 10 illustrates sections of a liquid storing chamber according to a second embodiment.

A second embodiment of the invention will now be described. In the following embodiments, components having operations and functions identical to those of the components in the first embodiment are provided with the same reference characters as in the first embodiment and description thereof is omitted, as appropriate. FIG. 10 illustrates sections of the liquid storing chamber 60 according to the second embodiment. The upper half of FIG. 10 is a sectional view of the filter chamber 50 and the liquid storing chamber 60 taken along the XZ plane, while the lower half is a sectional view taken along line X-X in the upper sectional view.

The bottom 62 of the liquid storing chamber 60 illustrated in FIG. 10 is provided with a restricting portion 64 at least between the first outlet DO1 and the projected area P' and between the second outlet DO2 and the projected area P', as viewed in the vertical direction. The restricting portion 64 restricts movement of the by-products K accumulated on the bottom 62. The restricting portion 64 illustrated in FIG. 10 is a recess including the projected area P' on the bottom 62. That is, the projected area P' is located inside the recess functioning as the restricting portion 64, while the first outlet DO1 and the second outlet DO2 are located outside the recess. The restricting portion 64 defines walls (inner walls of the recess functioning as the restricting portion 64) higher than the projected area P' around the projected area P'. The inner walls of the restricting portion 64 can suppress the by-products K from approaching the first outlet DO1 or the second outlet DO2 over the restricting portion 64 regardless of the occurrence of an ink flow on the bottom 62 that brings the by-products K. This configuration can more effectively suppress the by-products K from flowing into the liquid ejecting head 44, compared with the configuration without the restricting portion 64.

Figure 11:
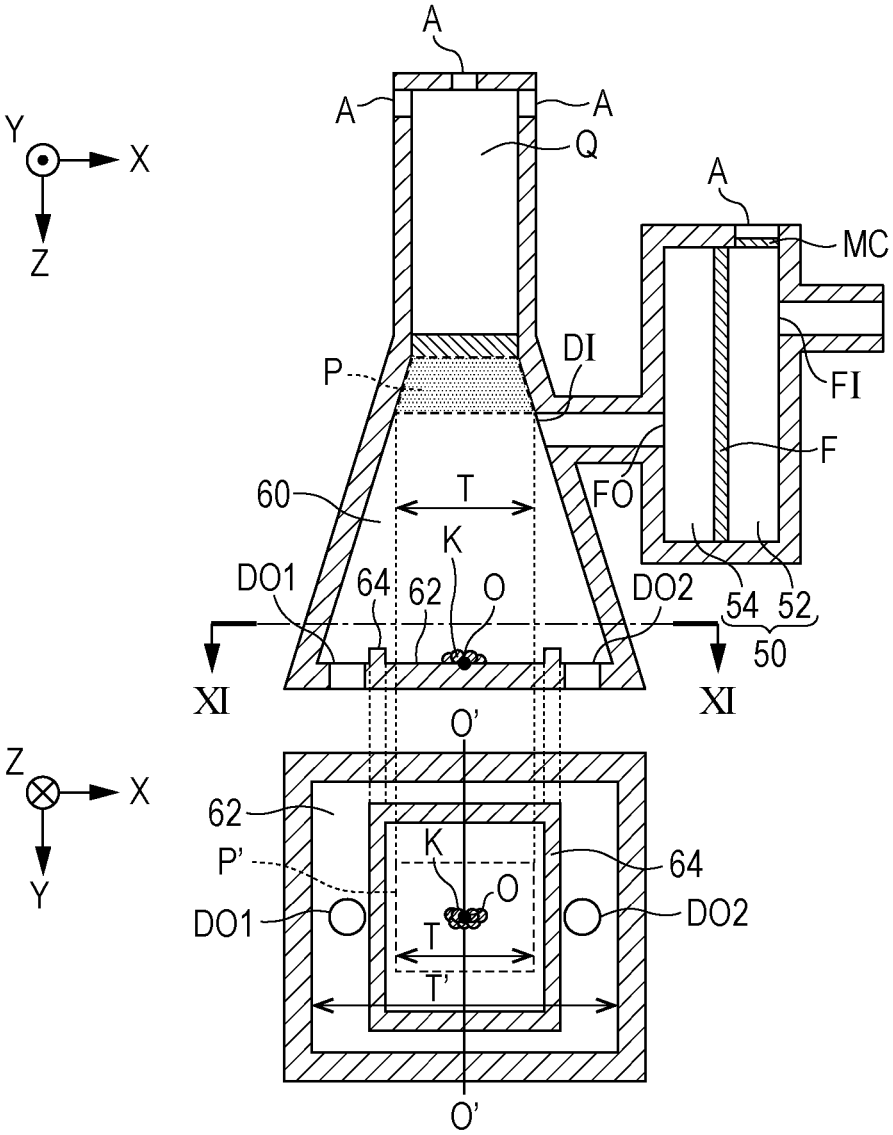
FIG. 11 illustrates sections of a liquid storing chamber according to a first modification of the second embodiment.

The restricting portion 64 may have a configuration other than the configuration illustrated in FIG. 10. For example, with reference to FIG. 11, the restricting portion 64 may be a ring-shaped protrusion surrounding the projected area P' on the bottom 62. FIG. 11 illustrates sections of the liquid storing chamber 60 according to a first modification of the second embodiment. The upper half of FIG. 11 is a sectional view of the filter chamber 50 and the liquid storing chamber 60 taken along the XZ plane, while the lower half is a sectional view taken along line XI-XI in the upper sectional view. With reference to FIG. 11, the projected area P' is located inside the ring-shaped protrusion functioning as the restricting portion 64, while the first outlet DO1 and the second outlet DO2 are located outside the ring-shaped protrusion. The restricting portion 64 defines walls (inner walls of the ring-shaped protrusion functioning as the restricting portion 64) higher than the projected area P' around the projected area P'. The inner walls of the restricting portion 64 can suppress the by-products K from approaching the first outlet DO1 or the second outlet DO2 over the restricting portion 64 regardless of the occurrence of an ink flow on the bottom 62 that brings the by-products K. This configuration can more effectively suppress the by-products K from flowing into the liquid ejecting head 44, compared with the configuration without the restricting portion 64.

Figure 12:
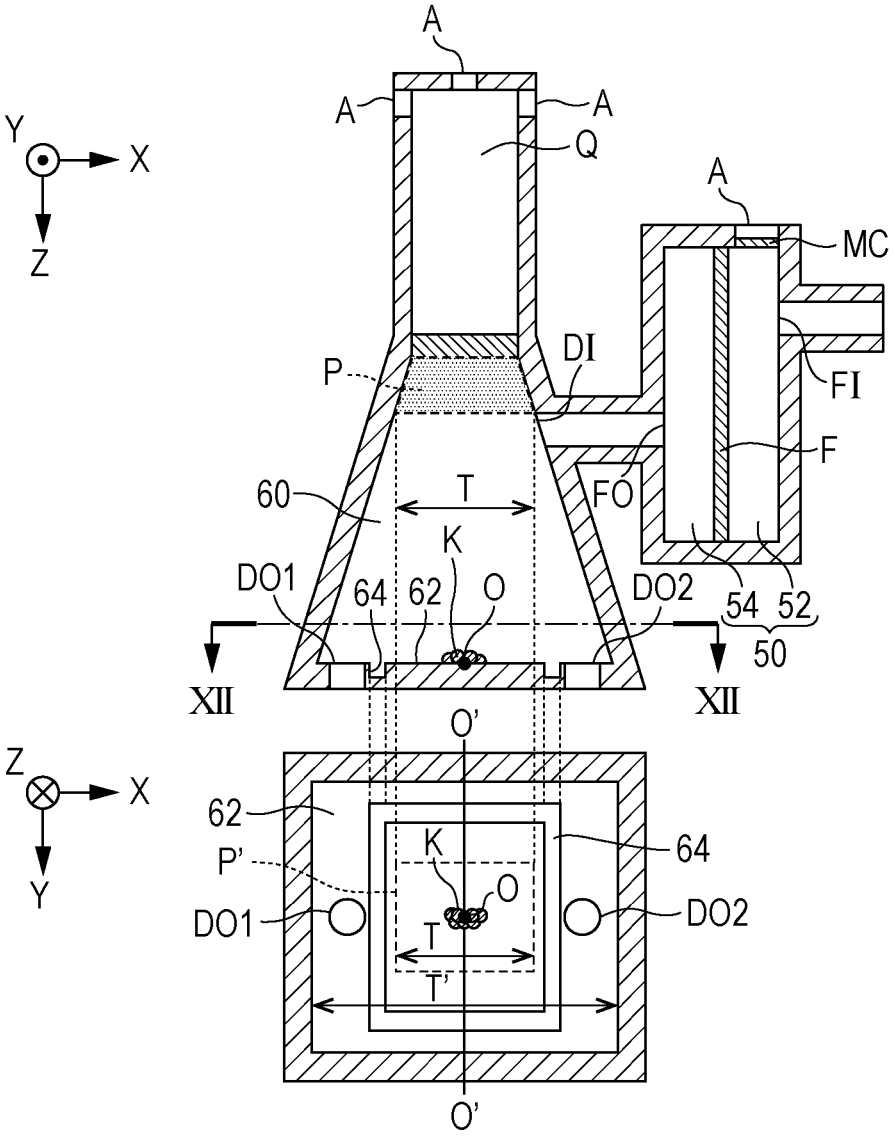
FIG. 12 illustrates sections of a liquid storing chamber according to a second modification of the second embodiment.

Alternatively, with reference to FIG. 12, the restricting portion 64 may be a ring-shaped groove surrounding the projected area P' on the bottom 62. FIG. 12 illustrates sections of the liquid storing chamber 60 according to a second modification of the second embodiment. The upper half of FIG. 12 is a sectional view of the filter chamber 50 and the liquid storing chamber 60 taken along the XZ plane, while the lower half is a sectional view taken along line XII-XII in the upper sectional view. With reference to FIG. 12, the projected area P' is located inside the ring-shaped groove functioning as the restricting portion 64, while the first outlet DO1 and the second outlet DO2 are located outside the ring-shaped groove. The ring-shaped groove functioning as the restricting portion 64 around the projected area P' can trap the by-products K and suppress the by-products K from approaching the first outlet DO1 or the second outlet DO2 over the ring-shaped groove regardless of the occurrence of an ink flow on the bottom 62 that brings the by-products K. This configuration can more effectively suppress the by-products K from flowing into the liquid ejecting head 44, compared with the configuration without the restricting portion 64.

Third Embodiment

Figure 13:
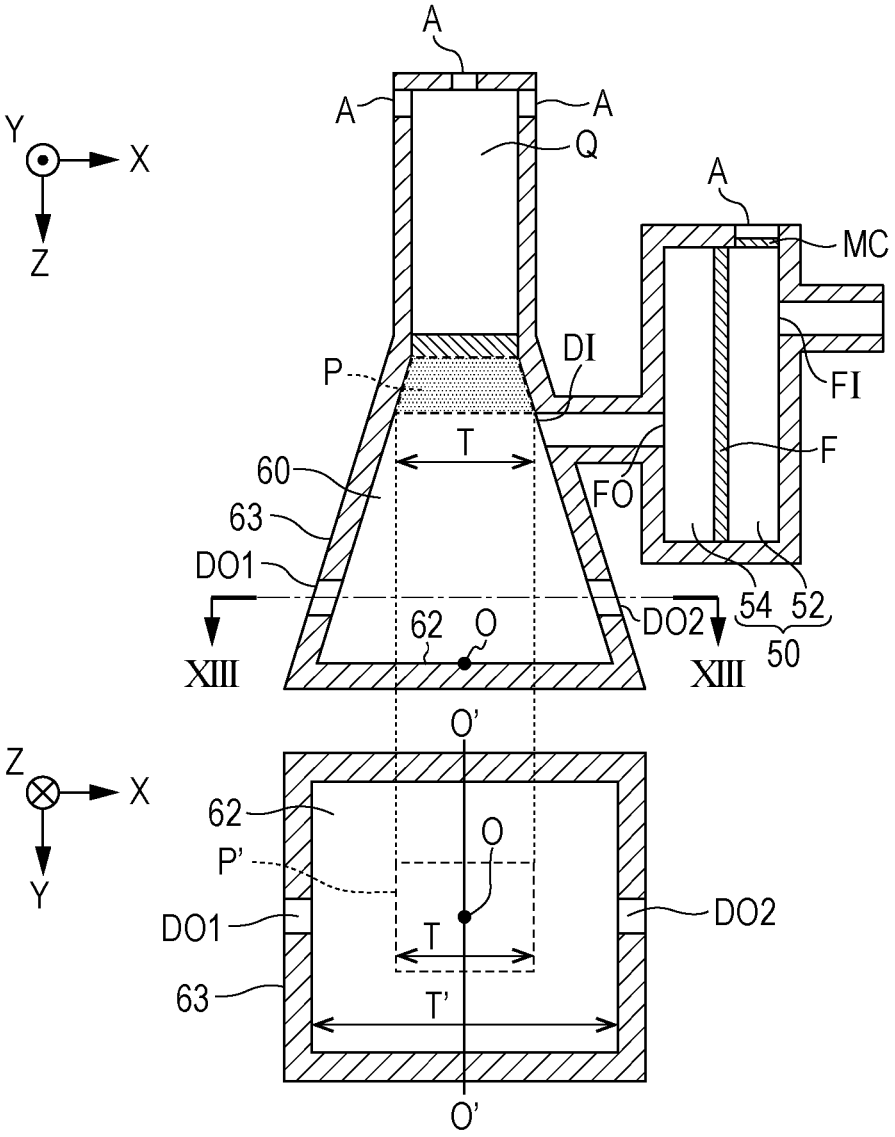
FIG. 13 illustrates sections of a liquid storing chamber according to a third embodiment.

A third embodiment of the invention will now be described. Although the first outlet DO1 and the second outlet DO2 are provided to the bottom 62 of the liquid storing chamber 60 in the first and second embodiments, the first outlet DO1 and the second outlet DO2 are provided to side surfaces 63 of the liquid storing chamber 60 in the third embodiment. FIG. 13 illustrates sections of the liquid storing chamber 60 according to the third embodiment. The upper half of FIG. 13 is a sectional view of the filter chamber 50 and the liquid storing chamber 60 taken along the XZ plane, while the lower half is a sectional view taken along line XIII-XIII in the upper sectional view.

With reference to FIG. 13, the first outlet DO1 is provided to the side surface 63 on the negative side in the X direction, while the second outlet DO2 is provided to the side surface 63 on the positive side in the X direction. The first outlet DO1 and the second outlet DO2 are thus spaced from the bottom 62 in the vertical direction. This configuration can more effectively suppress the by-products accumulated on the bottom 62 from flowing out through the first outlet DO1 or the second outlet DO2 and can more effectively suppress the by-products sinking from the bubble retention space P from reaching the first outlet DO1 or the second outlet DO2, compared with the configuration including the first outlet DO1 and the second outlet DO2 provided to the bottom 62.

In the configuration illustrated in FIG. 13, the first outlet DO1 and the second outlet DO2 are located on both sides of the imaginary center line O'-O' passing through the center O of the projected area P' of the bubble retention space P, as viewed in the vertical direction. This arrangement generates ink flows having components in the opposite directions from the imaginary center line O'-O' of the projected area P' to the first outlet DO1 and the second outlet DO2. The ink flow components in the opposite directions cancel movements of the by-products accumulated in the projected area P' and thus suppress the by-products from being displaced. The configuration illustrated in FIG. 13 can thus effectively suppress the by-products from flowing into the liquid ejecting head 44 and its nozzles N through the first outlet DO1 or the second outlet DO2.

The first outlet DO1 and the second outlet DO2 illustrated in FIG. 13 are located below the center of the liquid storing chamber 60 in the vertical direction. This configuration can provide a larger bubble retention space P, compared with the configuration including the first outlet DO1 and the second outlet DO2 located above the center of the liquid storing chamber 60. It is preferable that the first outlet DO1 and the second outlet DO2 be located near the bottom 62, for example, at a height equal to or lower than one quarter or one fifth of the height of the liquid storing chamber 60 in the vertical direction (that is, the distance from the bottom 62 to the ceiling of the liquid storing chamber 60 in the Z direction).

Fourth Embodiment

Figure 14:
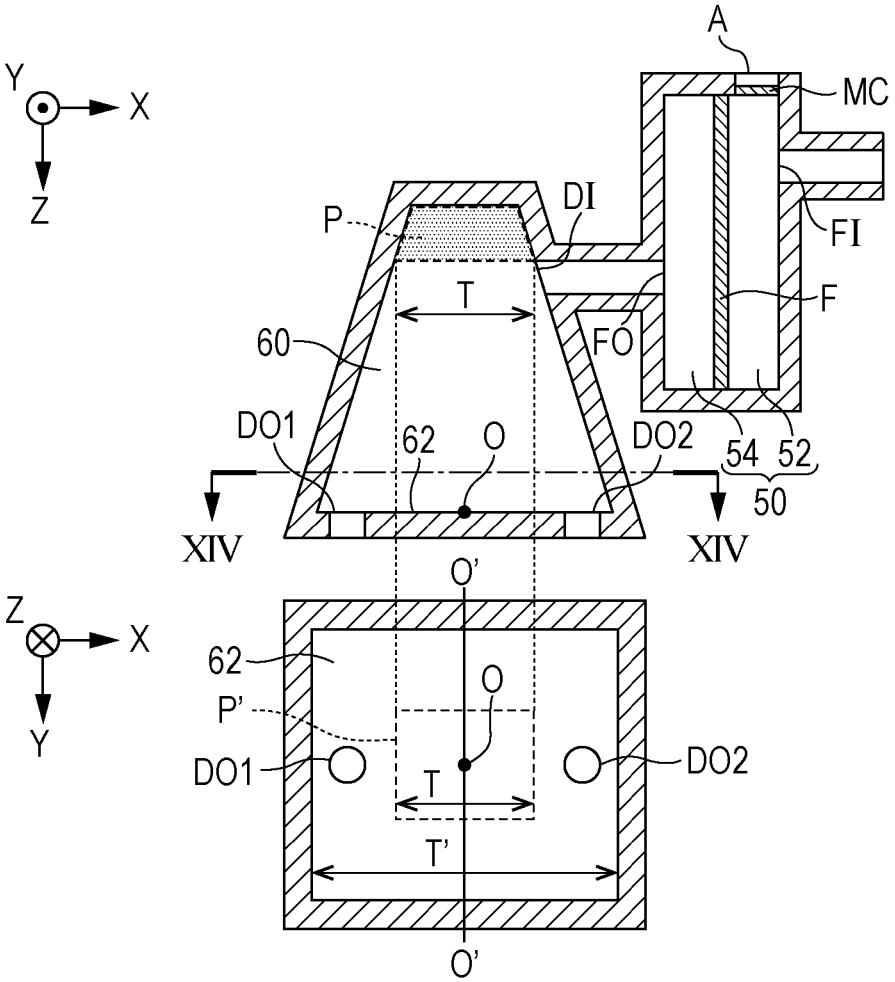
FIG. 14 illustrates sections of a liquid storing chamber according to a fourth embodiment.

A fourth embodiment of the invention will now be described. Although the liquid storing chamber 60 is provided with the degassing chamber Q in the first to third embodiments, no degassing chamber Q is provided in the fourth embodiment. FIG. 14 illustrates sections of the liquid storing chamber 60 according to the fourth embodiment. The upper half of FIG. 14 is a sectional view of the filter chamber 50 and the liquid storing chamber 60 taken along the XZ plane, while the lower half is a sectional view taken along line XIV-XIV in the upper sectional view. With reference to FIG. 14, the liquid storing chamber 60 is not provided with a gas permeable film MA or a degassing chamber Q. The other structures are identical to those illustrated in FIG. 4. In the configuration illustrated in FIG. 14, the nozzles N are vacuumed during the cleaning operation to discharge the bubbles retained in the bubble retention space P in the liquid storing chamber 60.

Figure 15:
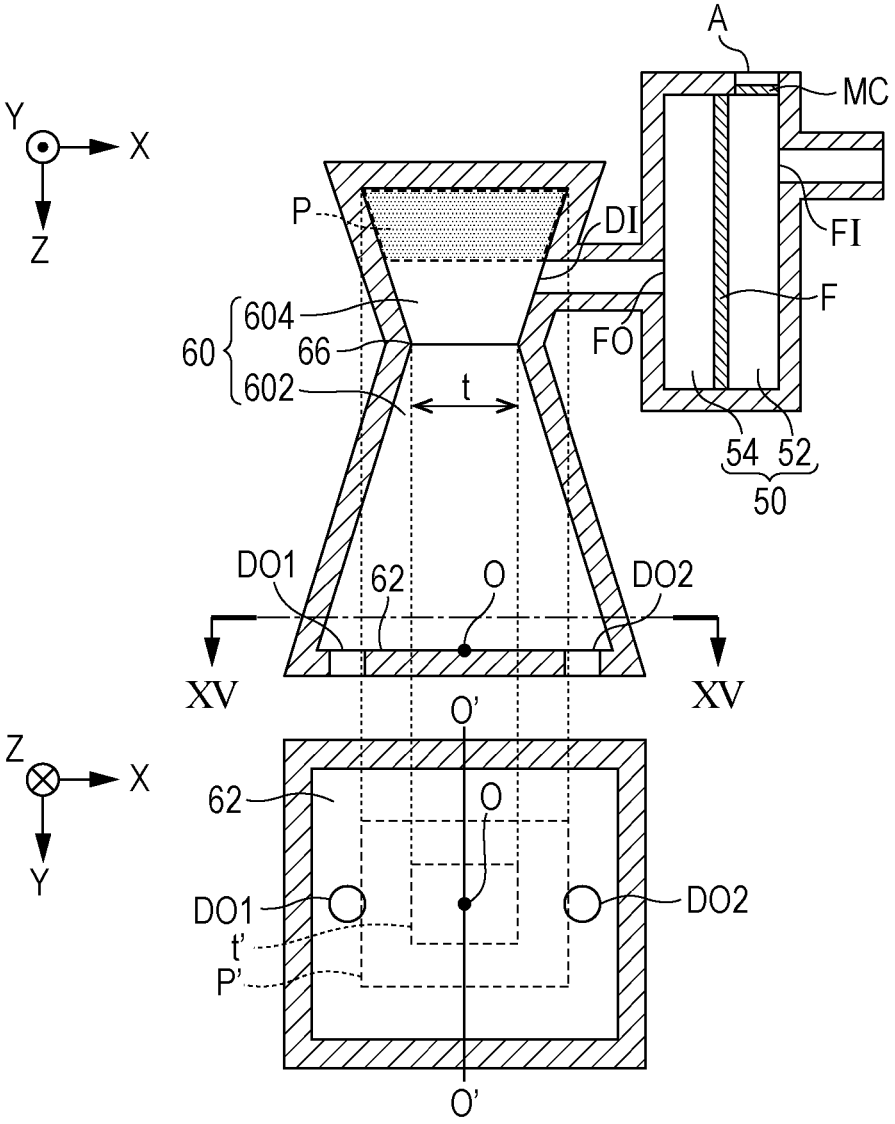
FIG. 15 illustrates sections of a liquid storing chamber according to a modification of the fourth embodiment.

Alternatively, as in a modification of the fourth embodiment illustrated in FIG. 15, the liquid storing chamber 60 may have a bottle neck 66. FIG. 15 illustrates sections of the liquid storing chamber 60 according to the modification of the fourth embodiment. The upper half of FIG. 15 is a sectional view of the filter chamber 50 and the liquid storing chamber 60 taken along the XZ plane, while the lower half is a sectional view taken along line XV-XV in the upper sectional view. The liquid storing chamber 60 illustrated in FIG. 15 has a shape defined by bonding two truncated pyramids in the opposite orientations to each other. The joint between the two truncated pyramids corresponds to the bottle neck 66.

Specifically, the liquid storing chamber 60 illustrated in FIG. 15 is composed of a lower truncated pyramid 602 of which the section orthogonal to the vertical direction gradually becomes larger in the positive Z direction, and an upper truncated pyramid 604 of which the section orthogonal to the vertical direction gradually becomes larger in the negative Z direction. With reference to FIG. 15, the upper truncated pyramid 604 has an inlet DI, while the lower truncated pyramid 602 has a first outlet DO1 and a second outlet DO2 on the bottom 62. In the configuration illustrated in FIG. 15, the space of the upper truncated pyramid 604 located above the inlet DI in the vertical direction functions as a bubble retention space P.

The bottle neck 66 illustrated in FIG. 15 has a smallest section t having the minimum area below the bubble retention space P in the vertical direction among the cross sections orthogonal to the vertical direction of the liquid storing chamber 60. Because of the bottle neck 66 having the smallest section t below the bubble retention space P in the vertical direction, the configuration can provide a larger section to the bubble retention space P than the smallest section t. Furthermore, regardless of the larger bubble retention space P, the by-products generated in the bubble retention space P sink through the smallest section t of the bottle neck 66 before arriving at the bottom 62. This configuration can cause the by-products to be accumulated in an area t' defined by projecting the smallest section t of the bottle neck 66 onto the bottom 62, which is smaller than the projected area P' of the bubble retention space P. That is, the configuration can keep the by-products accumulated in the projected area P' away from the first outlet DO1 and the second outlet DO2, thereby suppressing the by-products from flowing out.

In the configuration illustrated in FIG. 15, by-products are accumulated in the area t' smaller than the projected area P' of the bubble retention space P. Accordingly, the first outlet DO1 and the second outlet DO2 are only required to be located at least outside the area t'. The configuration can suppress the by-products from reaching the first outlet DO1 or the second outlet DO2.

Modifications

The above-illustrated aspects and embodiments may be modified in various manners. Some specific exemplary modifications will be described below. Any two or more of these modifications and the above embodiments may be appropriately combined with each other provided that there are no contradictions.

(1) The above embodiments are directed at a serial head printer in which the carriage 18 provided with the liquid ejecting head 44 thereon reciprocates in the X direction. The invention may also be applied to a line head printer including a liquid ejecting head 44 spanning the entire width of a medium 11.

(2) In the above embodiments, the liquid ejecting head 44 is of a piezoelectric type and includes the piezoelectric elements for providing mechanical oscillation to the pressure chambers. This liquid ejecting head 44 may be replaced with a thermal-type liquid ejecting head that includes heater elements for generating heat to cause bubbles in pressure chambers.

(3) The liquid ejecting apparatus 10 illustrated in the above embodiments may be applied to various types of machines, such as facsimile and copying machines, in addition to machines dedicated to printing. It should be noted that the liquid ejecting apparatus 10 according to the invention may be used for purposes other than printing. For example, liquid ejecting apparatuses that eject solutions of color filter materials can be used in the manufacture of, for example, color filters of liquid crystal displays, organic electroluminescence (EL) displays, and field emission displays (FEDs). Liquid ejecting apparatuses that eject a solution of conductive material can be used to form wiring and electrodes of circuit boards. Furthermore, liquid ejecting apparatuses that eject a solution of bioorganic material (a type of liquid) can be used as chip manufacturing apparatuses.

What is claimed is:

1. A liquid ejecting apparatus comprising:

a filter disposed in a liquid path for supplying liquid to nozzles of a liquid ejecting head; and a liquid storing chamber disposed downstream of the filter in the liquid path, the liquid storing chamber including:

an inlet through which the liquid enters the liquid storing chamber;

a bubble retention space disposed above the inlet in the vertical direction;

a bottom disposed below the bubble retention space in the vertical direction; and a first outlet and a second outlet through which the liquid exits the liquid storing chamber, wherein the liquid ejecting apparatus satisfies one of conditions (i) and (ii) below:

(i) the first outlet is located on one side of an imaginary center line and the second outlet is located on the other side of the imaginary center line, as viewed in the vertical direction, the imaginary center line passing through a center of a projected area, the projected area being defined by projecting the bubble retention space onto the bottom in the vertical direction; and (ii) the first outlet and the second outlet are located outside a projected area, as viewed in the vertical direction, the projected area being defined by projecting the bubble retention space onto the bottom in the vertical direction.

2. The liquid ejecting apparatus according to claim 1, wherein a direction from the center of the projected area to the second outlet is opposite to a direction from the center of the projected area to the first outlet, as viewed in the vertical direction.

3. The liquid ejecting apparatus according to claim 1, wherein the liquid storing chamber has a section orthogonal to the vertical direction below the bubble retention space in the vertical direction, the section having an area smaller than an area of the bottom.

4. The liquid ejecting apparatus according to claim 3, wherein the liquid storing chamber has a section orthogonal to the vertical direction below the bubble retention space in the vertical direction, the section having the smallest area.

5. The liquid ejecting apparatus according to claim 1, wherein the bottom comprises a restricting portion disposed at least between the first outlet and the projected area and between the second outlet and the projected area, as viewed in the vertical direction, the restricting portion being configured to restrict movement of by-products accumulated on the bottom.

6. The liquid ejecting apparatus according to claim 3, wherein the first outlet and the second outlet are located below the inlet in the vertical direction.

7. The liquid ejecting apparatus according to claim 6, wherein the first outlet and the second outlet are located below a center of the liquid storing chamber in the vertical direction.

8. The liquid ejecting apparatus according to claim 3, further comprising:

a degassing chamber disposed above the bubble retention space in the vertical direction, the degassing chamber being configured to degas the liquid with a gas permeable film.

9. The liquid ejecting apparatus according to claim 3, wherein the liquid is caused to exit the liquid storing chamber through one of the first outlet and the second outlet so as to generate a flow of the liquid on the bottom.

10. The liquid ejecting apparatus according to claim 3 that satisfies the condition (i).

11. The liquid ejecting apparatus according to claim 3 that satisfies the condition (ii).

12. A method of driving a liquid ejecting apparatus, the liquid ejecting apparatus including:

a filter disposed in a liquid path for supplying liquid to nozzles of a liquid ejecting head; and a liquid storing chamber disposed downstream of the filter in the liquid path, the liquid storing chamber including:

an inlet through which the liquid enters the liquid storing chamber;

a bubble retention space disposed above the inlet in the vertical direction;

a bottom disposed below the bubble retention space in the vertical direction; and a first outlet and a second outlet through which the liquid exits the liquid storing chamber, the first outlet being located on one side of an imaginary center line and the second outlet being located on the other side of the imaginary center line, as viewed in the vertical direction, the imaginary center line passing through a center of a projected area, the projected area being defined by projecting the bubble retention space onto the bottom in the vertical direction, the method comprising causing the liquid to exit the liquid storing chamber through the first outlet and the second outlet.

13. A method of driving a liquid ejecting apparatus, the liquid ejecting apparatus including:

a filter disposed in a liquid path for supplying liquid to nozzles of a liquid ejecting head; and a liquid storing chamber disposed downstream of the filter in the liquid path, the liquid storing chamber including:

an inlet through which the liquid enters the liquid storing chamber;

a bubble retention space disposed above the inlet in the vertical direction;

a bottom disposed below the bubble retention space in the vertical direction; and a first outlet and a second outlet through which the liquid exits the liquid storing chamber, the first outlet and the second outlet being located outside a projected area, as viewed in the vertical direction, the projected area being defined by projecting the bubble retention space onto the bottom in the vertical direction, the method comprising causing the liquid to exit the liquid storing chamber through the first outlet and the second outlet.

14. The method of driving the liquid ejecting apparatus according to claim 12, wherein the liquid ejecting apparatus further includes a degassing chamber disposed above the bubble retention space in the vertical direction, the degassing chamber being configured to degas the liquid with a gas permeable film, and the method further comprises discharging bubbles retained in the bubble retention space to the degassing chamber.

15. The method of driving the liquid ejecting apparatus according to claim 12, further comprising:

causing the liquid to exit the liquid storing chamber through one of the first outlet and the second outlet and generating a flow of the liquid on the bottom.

16. The liquid ejecting apparatus according to claim 1, further comprising:

a degassing chamber disposed above the bubble retention space in the vertical direction, the degassing chamber being configured to degas the liquid with a gas permeable film.

17. The liquid ejecting apparatus according to claim 1, wherein the liquid is caused to exit the liquid storing chamber through one of the first outlet and the second outlet so as to generate a flow of the liquid on the bottom.

18. The liquid ejecting apparatus according to claim 1 that satisfies the condition (i).

19. The liquid ejecting apparatus according to claim 1 that satisfies the condition (ii).

20. The liquid ejecting apparatus according to claim 19, wherein the liquid storing chamber has a section orthogonal to the vertical direction below the bubble retention space in the vertical direction, the section having the smallest area.

* * * * *